US011304526B2

(12) United States Patent
Udagawa et al.

(10) Patent No.: US 11,304,526 B2
(45) Date of Patent: Apr. 19, 2022

(54) SCREEN ATTACHMENT APPARATUS AND METHOD OF POSITIONING A SCREEN ADJACENT A WORK SURFACE

(71) Applicant: Knoll, Inc., East Greenville, PA (US)

(72) Inventors: Masamichi Udagawa, New York, NY (US); Sigrid Moeslinger, New York, NY (US); James Harrison McKenzie, Perkasie, PA (US)

(73) Assignee: Knoll, Inc., East Greenville, PA (US)

( * ) Notice: Subject to any disclaimer, the term of this patent is extended or adjusted under 35 U.S.C. 154(b) by 373 days.

(21) Appl. No.: 16/417,765

(22) Filed: May 21, 2019

(65) Prior Publication Data

US 2019/0365101 A1 Dec. 5, 2019

Related U.S. Application Data

(60) Provisional application No. 62/680,137, filed on Jun. 4, 2018.

(51) Int. Cl.
*A47B 97/00* (2006.01)

(52) U.S. Cl.
CPC ..... *A47B 97/00* (2013.01); *A47B 2200/12* (2013.01)

(58) Field of Classification Search
CPC ..... A47B 37/00; A47B 97/00; A47B 2200/12; E04B 2/7405
See application file for complete search history.

(56) References Cited

U.S. PATENT DOCUMENTS

| | | | | |
|---|---|---|---|---|
| 2,821,450 | A | 1/1958 | Knoll | |
| 2,981,583 | A * | 4/1961 | Eisenberg | A47F 3/142 312/140.4 |
| 3,053,601 | A * | 9/1962 | Korling | A47F 5/005 312/140.3 |
| 4,248,325 | A | 2/1981 | Georgopoulos | |
| 4,325,597 | A | 4/1982 | Morrison | |
| 5,287,909 | A | 2/1994 | King et al. | |
| 5,675,946 | A | 10/1997 | Verbeek et al. | |
| 5,680,893 | A | 10/1997 | Neer | |
| 5,729,867 | A * | 3/1998 | Carmichael | E04B 2/7429 16/225 |
| 5,890,782 | A * | 4/1999 | Alberts | A47B 17/00 312/196 |
| 5,966,879 | A | 10/1999 | Verbeek et al. | |
| 6,000,180 | A | 12/1999 | Goodman et al. | |
| 6,002,613 | A | 12/1999 | Cloud et al. | |
| D427,783 | S | 7/2000 | Luedke | |
| 6,367,213 | B1 | 4/2002 | Reuter et al. | |

(Continued)

FOREIGN PATENT DOCUMENTS

EP 3587835 A1 * 1/2020 ..... F16B 5/0614

*Primary Examiner* — Daniel J Rohrhoff
(74) *Attorney, Agent, or Firm* — Buchanan Ingersoll & Rooney PC

(57) ABSTRACT

A privacy screen attachment apparatus can include a screen body having a plurality of elongated recesses. The recesses can be positioned to define locations at which a connector is positionable to adjustably position the screen body adjacent to a work surface at multiple different locations along the screen body for providing different degrees of privacy and/or modesty. A plurality of connectors can be connected to the screen body via the recesses for connecting the screen body to an article of furniture, such as a counter, a table or a desk.

18 Claims, 17 Drawing Sheets

(56) References Cited

U.S. PATENT DOCUMENTS

| | | | | |
|---|---|---|---|---|
| D457,359 | S | 5/2002 | Chan | |
| D458,040 | S | 6/2002 | Stannis et al. | |
| 6,896,028 | B2 | 5/2005 | Brennan | |
| 7,140,134 | B1 * | 11/2006 | Flagg | G09F 7/18 40/607.14 |
| 7,310,918 | B1 | 12/2007 | Reuter et al. | |
| 7,789,025 | B2 | 9/2010 | Michaud, II et al. | |
| D653,862 | S | 2/2012 | Hairston | |
| 8,365,798 | B2 | 2/2013 | Feldpausch et al. | |
| D796,216 | S | 9/2017 | Rockwell et al. | |
| D800,459 | S | 10/2017 | Rockwell et al. | |
| 9,920,520 | B2 | 3/2018 | Udagawa et al. | |
| D824,195 | S | 7/2018 | Ezure et al. | |
| D843,136 | S | 3/2019 | Ezure et al. | |
| D861,379 | S | 10/2019 | Citterio | |
| D861,380 | S | 10/2019 | Citterio | |
| D863,832 | S | 10/2019 | Citterio | |
| D863,833 | S | 10/2019 | Moore | |
| D877,541 | S | 3/2020 | Yamamoto | |
| D878,812 | S | 3/2020 | Udagawa et al. | |
| 2002/0062933 | A1 * | 5/2002 | Insalaco | E04B 2/7405 160/351 |
| 2002/0189506 | A1 * | 12/2002 | Hamilton | A47B 17/033 108/50.02 |
| 2005/0236173 | A1 | 10/2005 | VanderVelde | |
| 2012/0304441 | A1 * | 12/2012 | Henriott | A47B 13/00 29/428 |
| 2016/0348358 | A1 * | 12/2016 | Udagawa | E04B 2/7422 |
| 2017/0226749 | A1 | 8/2017 | Fjetland | |
| 2018/0055229 | A1 | 3/2018 | Game et al. | |
| 2019/0223590 | A1 | 7/2019 | Moore | |
| 2019/0365101 | A1 | 12/2019 | Udagawa et al. | |

* cited by examiner

SCREEN ATTACHMENT APPARATUS AND METHOD OF POSITIONING A SCREEN ADJACENT A WORK SURFACE

CROSS-REFERENCE TO RELATED APPLICATIONS

The present application claims priority to U.S. Provisional patent Application No. 62/680,137, filed on Jun. 4, 2018. The entirety of this provisional patent application is incorporated by reference herein.

FIELD

The present innovation relates to privacy screens and methods and mechanisms used to attach privacy screens adjacent to a work surface of an articular of furniture (e.g. adjacent a desktop of a desk, adjacent a countertop of a counter, or adjacent a tabletop of a table etc.)

BACKGROUND

Privacy screens and modesty screens can be utilized to provide a visible barrier in a workplace setting or other setting. In the art, the term "privacy" can often refer to the ability of a screen to provide a visible barrier above a work surface (e.g. to provide a barrier to prevent seeing a person's chest or head) while the term "modesty" can often refer to the ability of a screen to provide a visible barrier below a work surface (e.g. to provide a barrier from seeing a person's knees or legs). Examples of privacy screens and/or modesty screens can be appreciated from U.S. Pat. Nos. 9,920,520, 8,365,798, 7,789,025, 7,310,918, 6,896,028, 6,367,213, 6,002,613, 6,000,180, 5,966,879, 5,675,946, 5,680,893, 5,287,909, 4,325,597, 4,248,325, and 2,821,450, U.S. Design Pat. Nos. D800,459, D796,216, D653,862, D458, 040, D457,359, and D427,783 and U.S. Patent Application Publication Nos. 2017/0226749 and 2012/0304441.

SUMMARY

A screen attachment apparatus and method of making and using the same is provided. Embodiments of the attachment mechanism and method can be configured to adjustably position a screen adjacent a countertop, desktop, tabletop or other work surface for providing a visible barrier along at least a portion of a perimeter of such a work surface. In some embodiments, the screen attachment apparatus may be configured to attach a privacy screen adjacent to a work surface so that the privacy screen can provide varying levels of privacy ranging from a position at which the screen provides both modesty and privacy by providing a visible barrier significantly above and below a work surface to a position in which only privacy screening is provided without any significant modesty screen functionality (e.g. there is not a barrier blocking a significant amount of visibility below a work surface).

In some embodiments, the screen body can define a plurality of columns of spaced apart recesses (e.g. a first column near a first end or side of the body, a second column near a second end or second side of the body, and a third column between the first and second columns (e.g. a column near a center of the body etc.)). Each column can have two recesses that are spaced apart from each other, three spaced apart recesses, or more than three spaced apart recesses. In some embodiments, the recesses may be rectangular or oval in shape. In other embodiments, the recesses can have other shapes. The recesses can be configured to receive connectors for attachment of the screen body adjacent a work surface. There may be a single connector respective for each column of recesses (e.g. if there are two columns of recesses, there may be two connectors—one for each column, if there are three columns of recesses, there may be three connectors—one for each column, etc.). Each connector can be positioned in any of the spaced apart recesses for its respective column to provide a pre-selected visibility barrier that extends mostly above the work surface, mostly below the work surface, or be positioned so that about half the length or height of the screen body extends above the work surface and about half the length or height of the screen body extends below the work surface. The use of the connectors and recesses can also permit a user to re-adjust the positioning of a screen body by moving the connector from an initially or first positioned recess to a different or second recesses after the first connector is positioned in that initial recess. Such moving can occur by removing one or more fasteners to decouple the connector from the screen body and subsequently move the screen body so that a different recess is positioned to receive the connector, and subsequently inserting one or more fasteners through the screen body and connector for re-coupling of the screen body to the connector at the newly selected recess.

In some embodiments, each screen body can have a first face and a second opposite face. Each column of recesses can include a column of recess on the first face and a corresponding column of recesses on the second face. Each recess in a column on the first face can be in a position that matches, or corresponds, to the location of a recess in the second face. A connector positioned at a recess may be positioned so that a part of a connector is in the recess on the second face and another part of the connector is in the corresponding recess in the first face. There may therefore be embodiments in which there are multiple sets of columns where each set of columns of spaced apart recesses such that each recess of one column in a first face of the screen body is positioned to correspond to a position of a recess of the other column of recesses in the second face of the screen body. In some embodiments, the corresponding positioned recesses from a set of columns of recesses can be located at a same height and width (or length and width) coordinates on the screen body, but be positioned on opposite faces of the screen body.

Embodiments of a method of positioning a privacy screen adjacent a work surface can include providing a screen body. The screen body can have: a first face and a second face opposite the first face, the first face having a first column of spaced apart recesses and a second column of spaced apart recesses, the second face having a first column of spaced apart recesses and a second column of spaced apart recesses, each recess of the first column of spaced apart recesses of the first face being positioned to correspond to a position of a respective recess of the first column of spaced apart recesses of the second face; and each recess of the second column of spaced apart recesses of the first face being positioned to correspond to a position of a respective recess of the second column of spaced apart recesses of the second face. The method can also include providing a plurality of mounting connectors comprising a first mounting connector and a second mounting connector. Each of the mounting connectors can include: a first outer cap element and a second inner element configured for attachment to an article of furniture adjacent a work surface of the article of furniture. The first outer cap element of the first mounting connector can be sized and configured for positioning in any of the recesses of the first column of spaced apart recesses of the first face and the first outer cap element of the second mounting connector can be sized and configured for positioning in any of the recesses of the second column of spaced apart recesses of the first face. The second inner element of the first mounting connector can be sized and configured for positioning in any of the recesses of the first column of spaced apart recesses of the second face and the second inner element of the second mounting connector can be sized and configured for positioning in any of the recesses of the second column of spaced apart recesses of the second face. The method can also include: positioning the first outer cap element of the first mounting connector in a first recesses of the first column of spaced apart recesses of the first face; positioning the second inner element of the first mounting connector in a first recess of the recesses of the first column of spaced apart recesses of the second face that corresponds to the first recess of the first column of spaced apart recesses of the first face in which the first outer cap element of the first mounting connector is positioned; passing a first fastener through the screen body such that the first fastener extends from the first outer cap element of the first mounting connector to the second inner element of the first mounting connector; positioning the first outer cap element of the second mounting connector in a first recess of the second column of spaced apart recesses of the first face; positioning the second inner element of the second mounting connector in a first recess of the second column of spaced apart recesses of the second face that corresponds to the first recess of the second column of spaced apart recesses of the first face in which the first outer cap element of the second mounting connector is positioned; and passing a second fastener through the screen body such that the second fastener extends from the first outer cap element of the second mounting connector to the second inner element of the second mounting connector.

Embodiments of the method can utilize a number of other steps. For instance, embodiments of the method can include drilling a first hole through the screen body such that the first hole in the screen body aligns with a first hole in the first outer cap element of the first mounting connector and a first hole in the second inner element of the first mounting connector. This drilling can occur prior to the first fastener being passed through the screen body. A second hole can also be drilled through the screen body such that the second hole in the screen body aligns with a first hole in the first outer cap element of the second mounting connector and a first hole in the second inner element of the second mounting connector. This drilling can also occur prior to the second fastener being passed through the screen body.

Embodiments of the method can also be configured to facilitate repositioning of the screen body. For instance, embodiments of the method can also include: removing the first fastener from the screen body and removing the second fastener from the screen body. Thereafter, the screen body can be repositioned adjacent the work surface by a first repositioning process that includes: positioning the first outer cap element of the first mounting connector in a second recesses of the first column of spaced apart recesses of the first face; positioning the second inner element of the first mounting connector in a second recess of the recesses of the first column of spaced apart recesses of the second face that corresponds to the second recess of the first column of spaced apart recesses of the first face in which the first outer cap element is positioned; passing the first fastener through the screen body while the first outer cap element of the first mounting connector is positioned in the second recess of the first column of spaced apart recesses of the first face and the second inner element of the first mounting connector is positioned in the second recess of the first column of spaced apart recesses of the second face such that the first fastener extends from the first outer cap element of the first mounting connector to the second inner element of the first mounting connector; positioning the first outer cap element of the second mounting connector in a second recess of the second column of spaced apart recesses of the first face; positioning the second inner element of the second mounting connector in a second recess of the second column of spaced apart recesses of the second face that corresponds to the second recess of the second column of spaced apart recesses of the first face in which the first outer cap element of the second mounting connector is positioned; and passing the second fastener through the screen body while the first outer cap element of the second mounting connector is positioned in the second recess of the second column of spaced apart recesses of the first face and the second inner element of the second mounting connector is positioned in the second recess of the second column of spaced apart recesses of the second face such that the second fastener extends from the first outer cap element of the second mounting connector to the second inner element of the second mounting connector.

Embodiments of the method can also utilize a second repositioning process that may occur after the first repositioning process. For example, embodiments of the method can include removing the first fastener from the screen body after the first repositioning process occurred and removing the second fastener from the screen body after the first repositioning process occurred. Thereafter, the screen body can be repositioned yet again adjacent to the work surface by a second repositioning process that includes: positioning the first outer cap element of the first mounting connector in a third recess of the first column of spaced apart recesses of the first face; positioning the second inner element of the first mounting connector in a third recess of the recesses of the first column of spaced apart recesses of the second face that corresponds to the third recess of the first column of spaced apart recesses of the first face in which the first outer cap element is positioned; passing the first fastener through the screen body while the first outer cap element of the first mounting connector is positioned in the third recess of the first column of spaced apart recesses of the first face and the second inner element of the first mounting connector is positioned in the third recess of the first column of spaced apart recesses of the second face such that the first fastener extends from the first outer cap element of the first mounting connector to the second inner element of the first mounting connector; positioning the first outer cap element of the second mounting connector in a third recess of the second column of spaced apart recesses of the first face; positioning the second inner element of the second mounting connector in a third recess of the second column of spaced apart recesses of the second face that corresponds to the third recess of the second column of spaced apart recesses of the first face in which the first outer cap element of the second mounting connector is positioned; and passing the second fastener through the screen body while the first outer cap element of the second mounting connector is positioned in the third recess of the second column of spaced apart recesses of the first face and the second inner element of the second mounting connector is positioned in the third recess of the second column of spaced apart recesses of the second face such that the second fastener extends from the first outer cap element of the second mounting connector to the second inner element of the second mounting connector.

Each of the mounting connectors can include a third work surface attachment connector element for attachment to the work surface. The third work surface attachment connector element can have a receptacle for receiving the second inner element. Embodiments of the method can utilize such a component. For example, embodiments of the method can include: positioning the third work surface attachment connector element of the first mounting connector adjacent a peripheral edge of the work surface, positioning the third work surface attachment connector element of the second mounting connector adjacent the peripheral edge of the work surface, positioning the second inner element of the first mounting connector into the receptacle of the third work surface attachment connector element of the first mounting connector, and positioning the second inner element of the second mounting connector into the receptacle of the third work surface attachment connector element of the second mounting connector.

For each mounting connector, the third work surface attachment connector element can have a hole in communication with the receptacle for positioning of a third fastener to help retain the second inner element within the receptacle. Embodiments of the method that utilize a third work surface attachment connector element can also include positioning a third fastener through the hole to help retain the second inner element of the first mounting connector within the receptacle of the third work surface attachment connector element of the first mounting connector. Embodiments of the method that utilize a third work surface attachment connector element can additionally include positioning another third fastener through the hole of the third work surface attachment connector element of the second mounting connector to help retain the second inner element of the second mounting connector within the receptacle of the third work surface attachment connector element of the second mounting connector.

In some embodiments, the second inner element can have a profile sized and shaped to mate with a size and shape of the receptacle of a corresponding third work surface attachment connector element. The profile and receptacle shapes can mate with each other and be complimentary of each other to facilitate a downward motion of the inner element into the receptacle (e.g. via a downward sliding motion to locate the inner element within the receptacle, etc.). For example, when the positioning of the second inner element of the first mounting connector into the receptacle of the third work surface attachment connector element of the first mounting connector occurs, this can include downwardly moving the second inner element of the first mounting connector into the receptacle of the third work surface attachment connector element of the first mounting connector. Similarly, when the positioning of the second inner element of the second mounting connector into the receptacle of the third work surface attachment connector element of the second mounting connector occurs, this can include downwardly moving the second inner element of the second mounting connector into the receptacle of the third work surface attachment connector element of the second mounting connector.

A privacy screen attachment apparatus is also provided. Such an apparatus can include a plurality of mounting connectors comprising a first mounting connector and a second mounting connector. Each of the mounting connectors can include a first outer cap element and a second inner element configured for attachment to an article of furniture adjacent a work surface of the article of furniture. The first outer cap element of the first mounting connector can be sized and configured for positioning in any recess of a first column of spaced apart recesses of a first face of a privacy screen body and the first outer cap element of the second mounting connector can be sized and configured for positioning in recess of a second column of spaced apart recesses of the first face. The second inner element of the first mounting connector can be sized and configured for positioning in any of the recesses of a first column of spaced apart recesses of a second face of the privacy screen body and the second inner element of the second mounting connector can be sized and configured for positioning in any recess of a second column of spaced apart recesses of the second face.

Some embodiments of the privacy screen attachment apparatus can also be configured so that each of the mounting connectors comprises a third work surface attachment connector element for attachment to a work surface. The third work surface attachment connector element can have a receptacle for receiving the second inner element. In some embodiments, the third work surface attachment connector element of each of the mounting connectors can also have a hole in communication with the receptacle for positioning of a fastener to help retain the second inner element within the receptacle. The second inner element can have a profile sized and shaped to mate with a size and shape of the receptacle to facilitate downward motion of the second inner element into the receptacle for positioning the second inner element in the receptacle.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of privacy screen apparatuses and screen attachment apparatuses are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
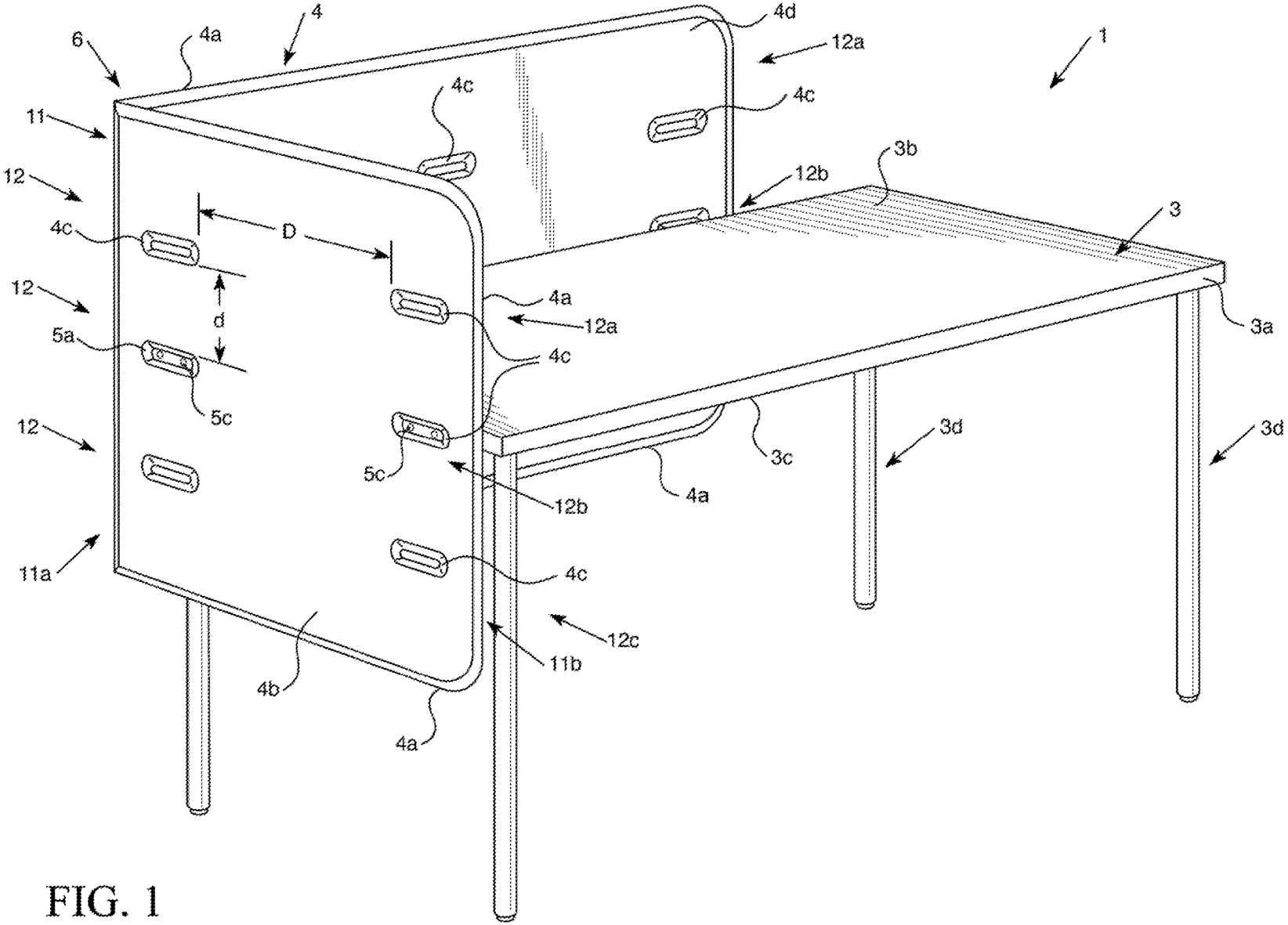
FIG. 1 is a perspective view of a first exemplary embodiment of a privacy apparatus having a screen attachment apparatus for attaching a screen body adjacent a work surface.
Figure 2:
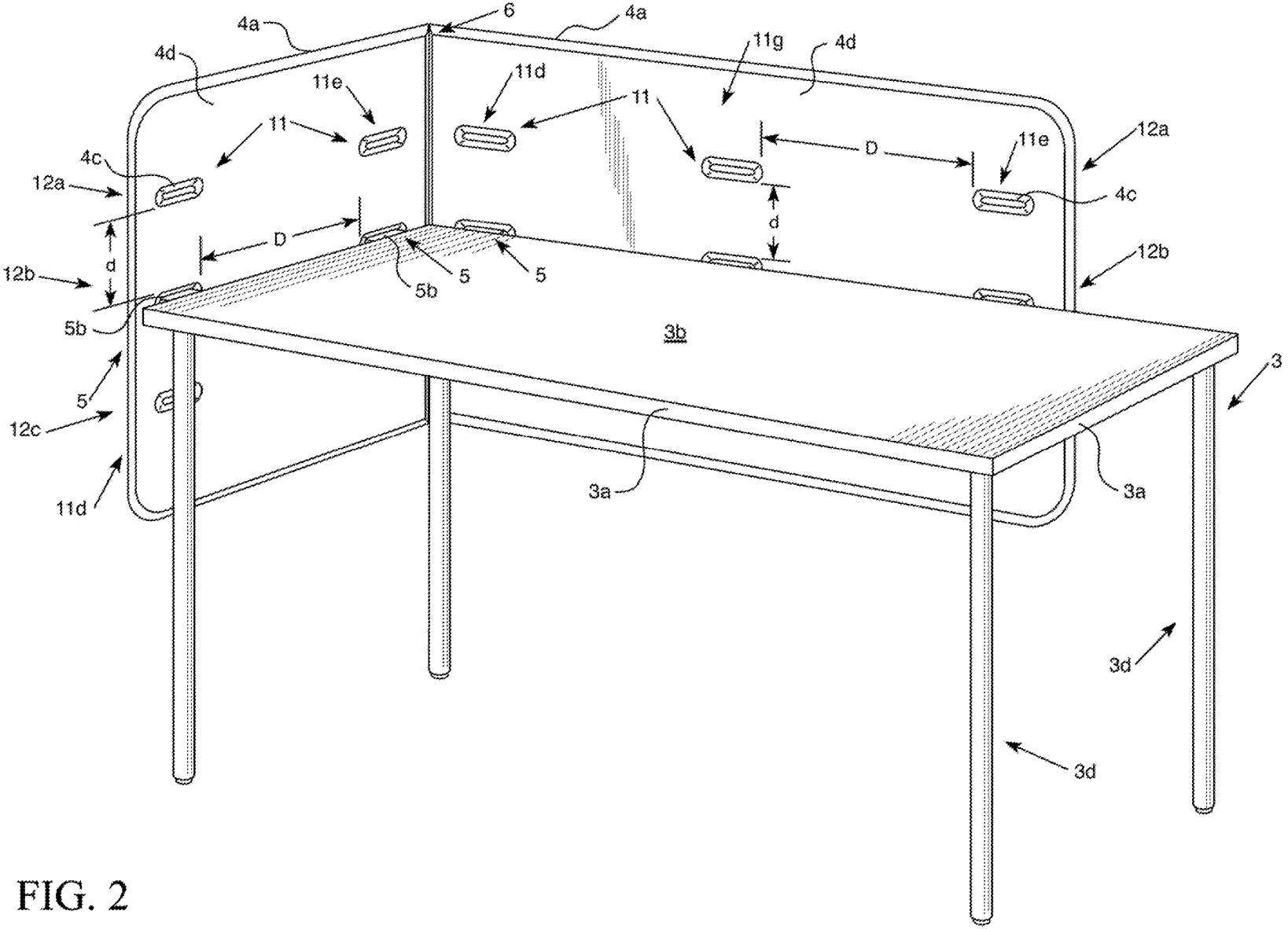
FIG. 2 is a perspective view of the first exemplary embodiment of the privacy apparatus having a screen attachment apparatus for attaching a screen body adjacent a work surface.
Figure 3:
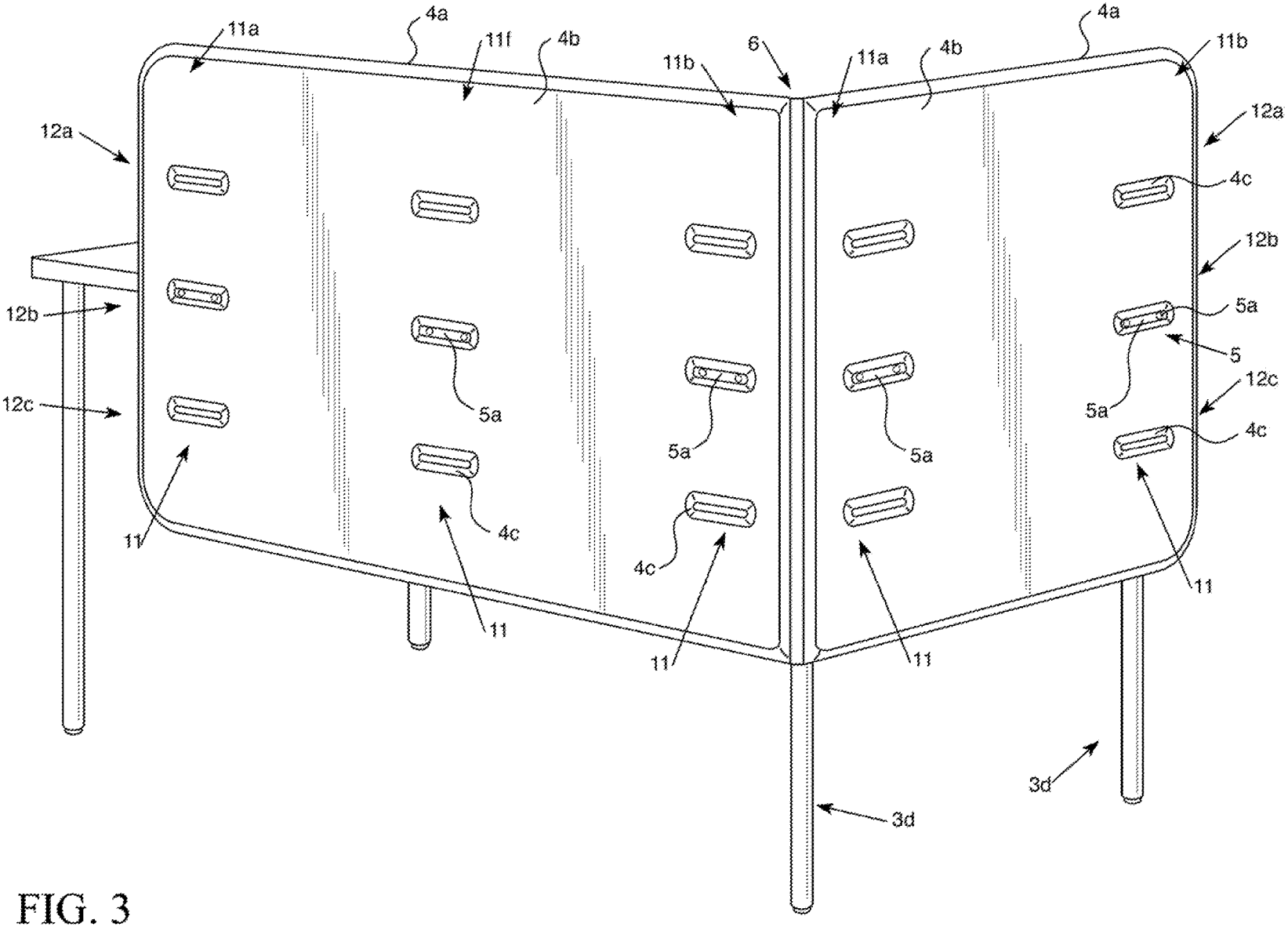
FIG. 3 is a perspective view of the first exemplary embodiment of the privacy apparatus having a screen attachment apparatus for attaching a screen body adjacent a work surface.
Figure 4:
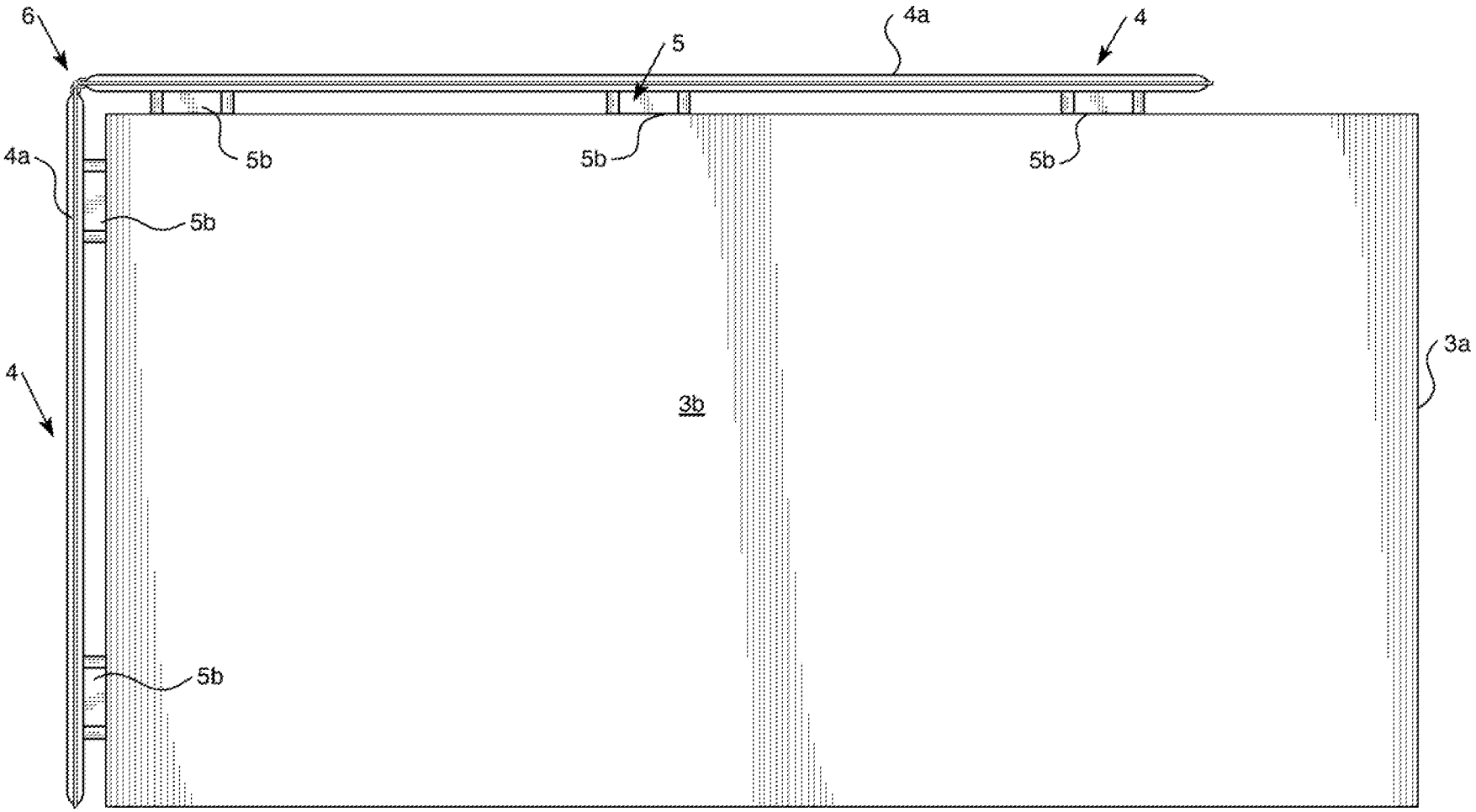
FIG. 4 is a top view of the first exemplary embodiment of the privacy apparatus having a screen attachment apparatus for attaching a screen body adjacent a work surface.
Figure 5:
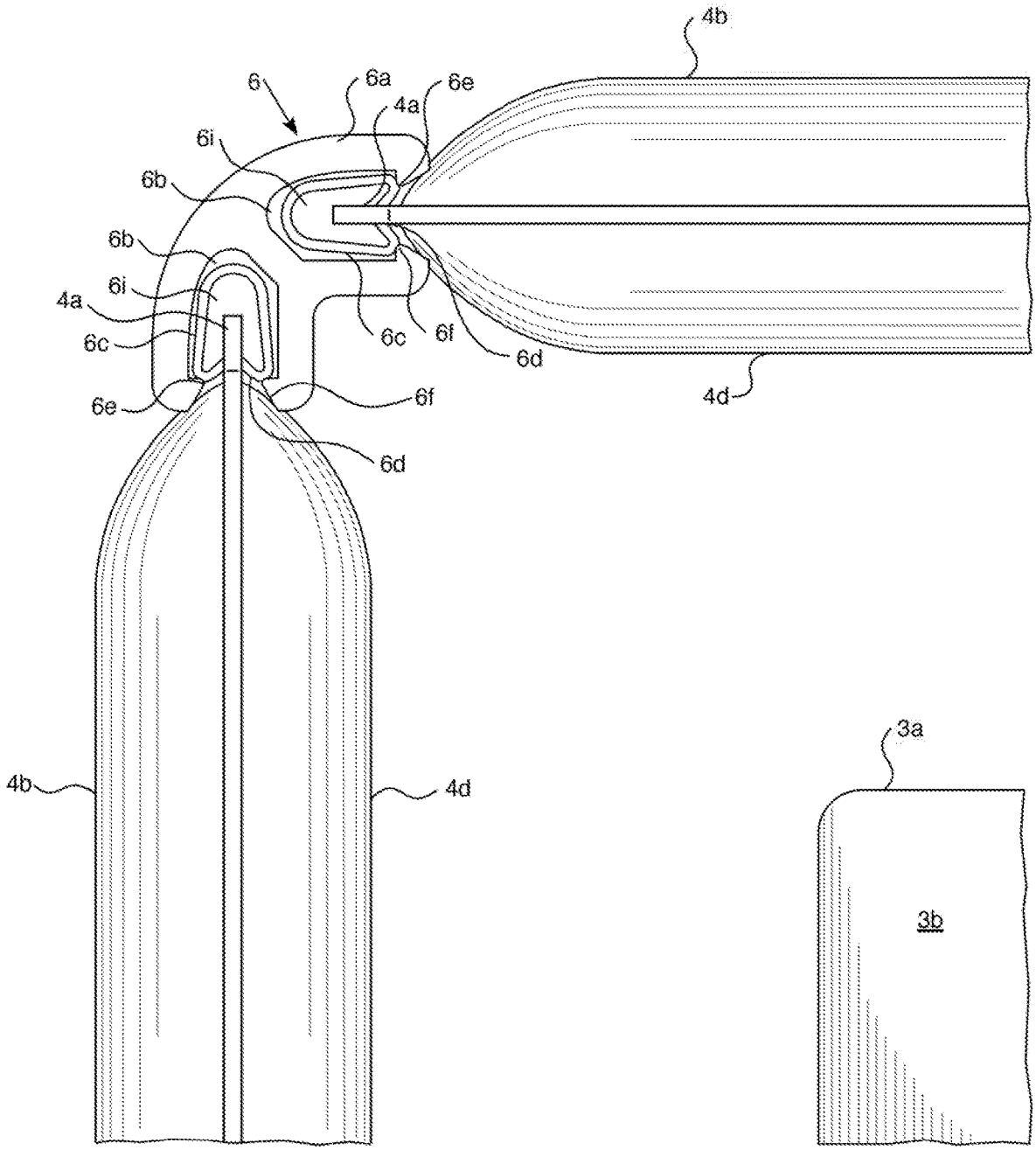
FIG. 5 is an enlarged fragmentary top view of the first exemplary embodiment of the privacy apparatus having a screen attachment apparatus for attaching a screen adjacent a work surface that illustrates an exemplary screen body connector for connecting adjacent edges of screen bodies together.
Figure 6:
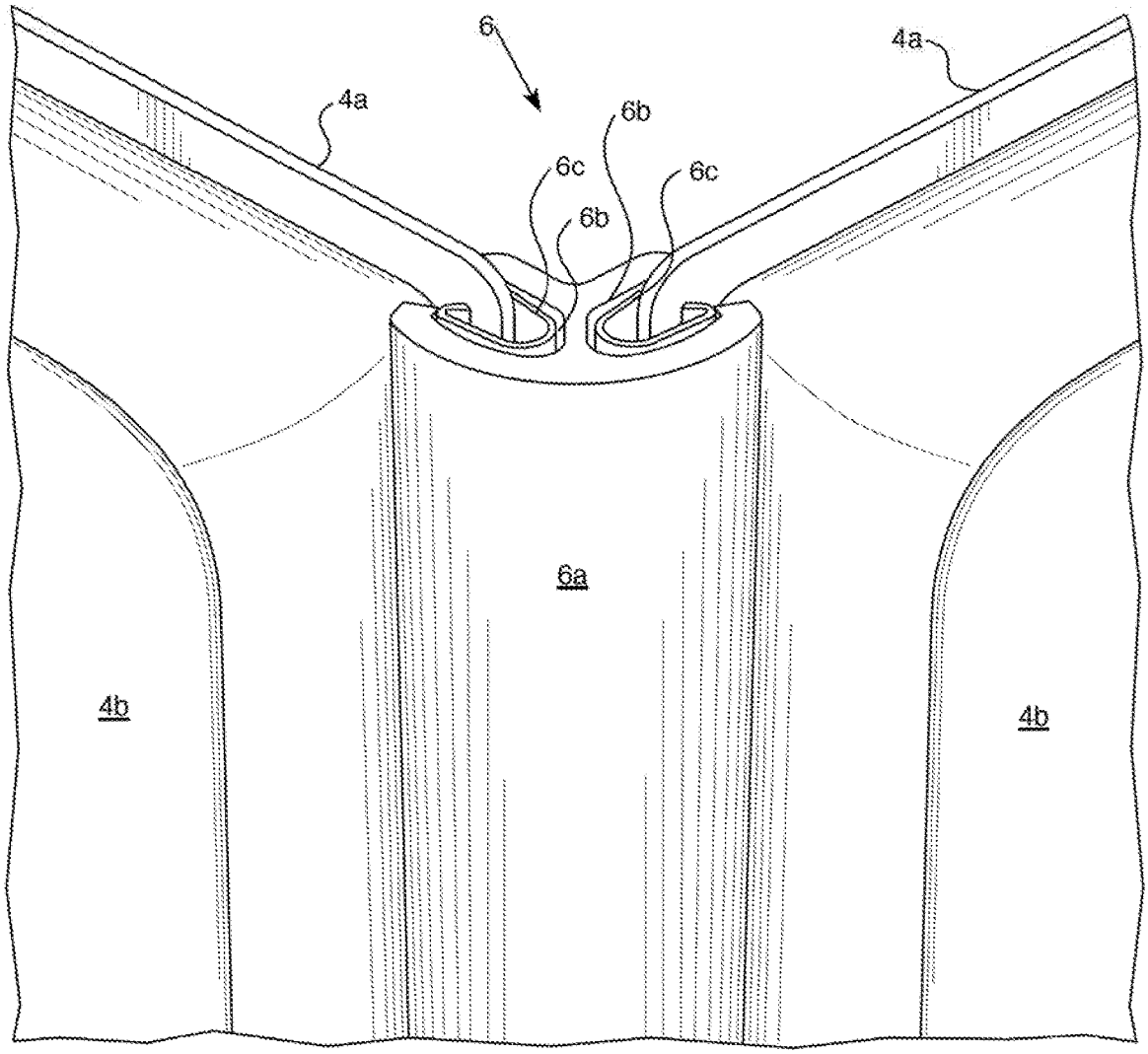
FIG. 6 is a fragmentary perspective view of the first exemplary embodiment of the screen apparatus having a screen attachment apparatus for attaching a screen adjacent a work surface that illustrates the screen body connector for connecting adjacent edges of screen bodies together.
Figure 7:
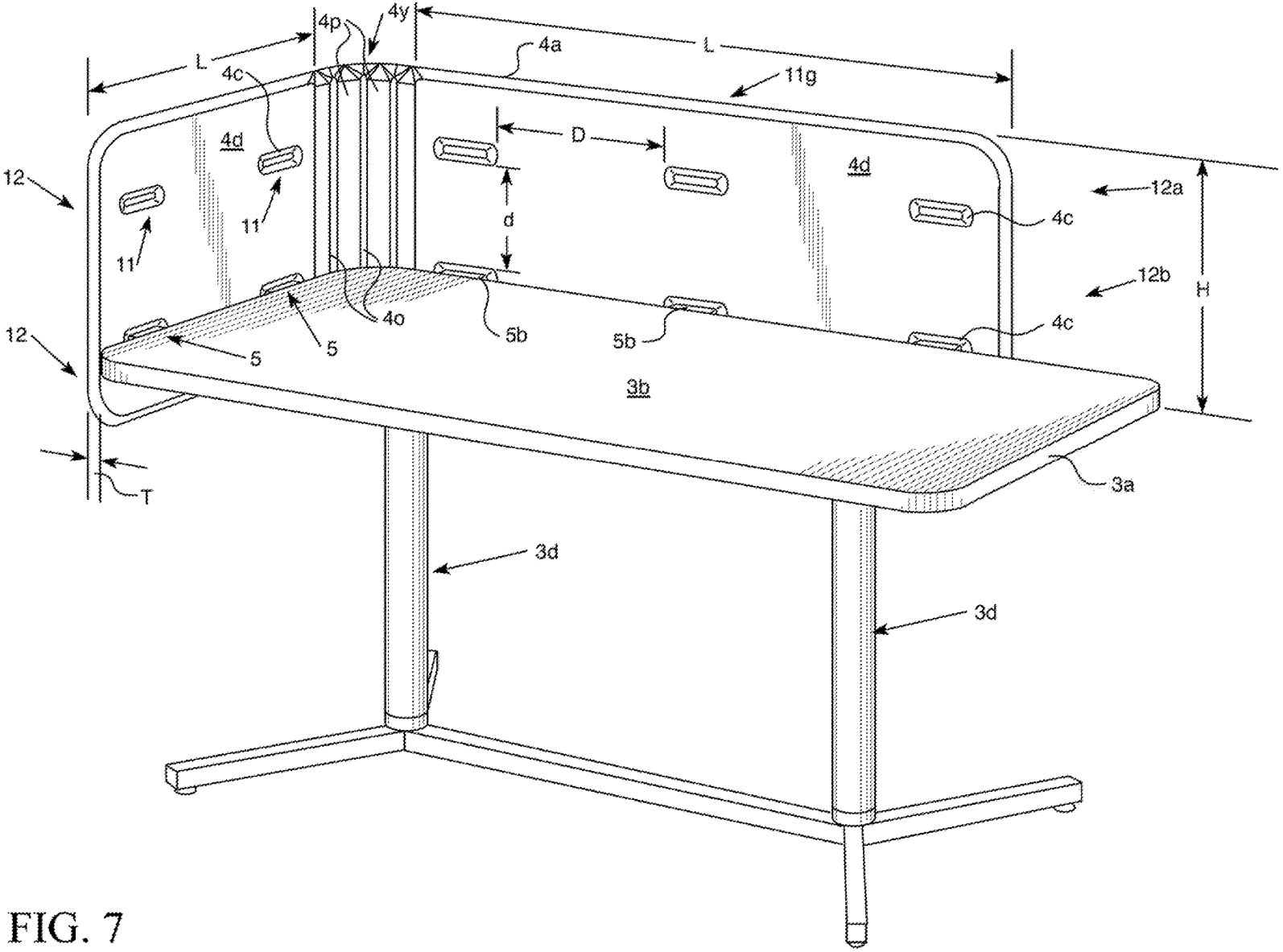
FIG. 7 is a perspective view of a second exemplary embodiment of the privacy apparatus having a screen attachment apparatus for attaching a screen body adjacent a work surface.
Figure 8:
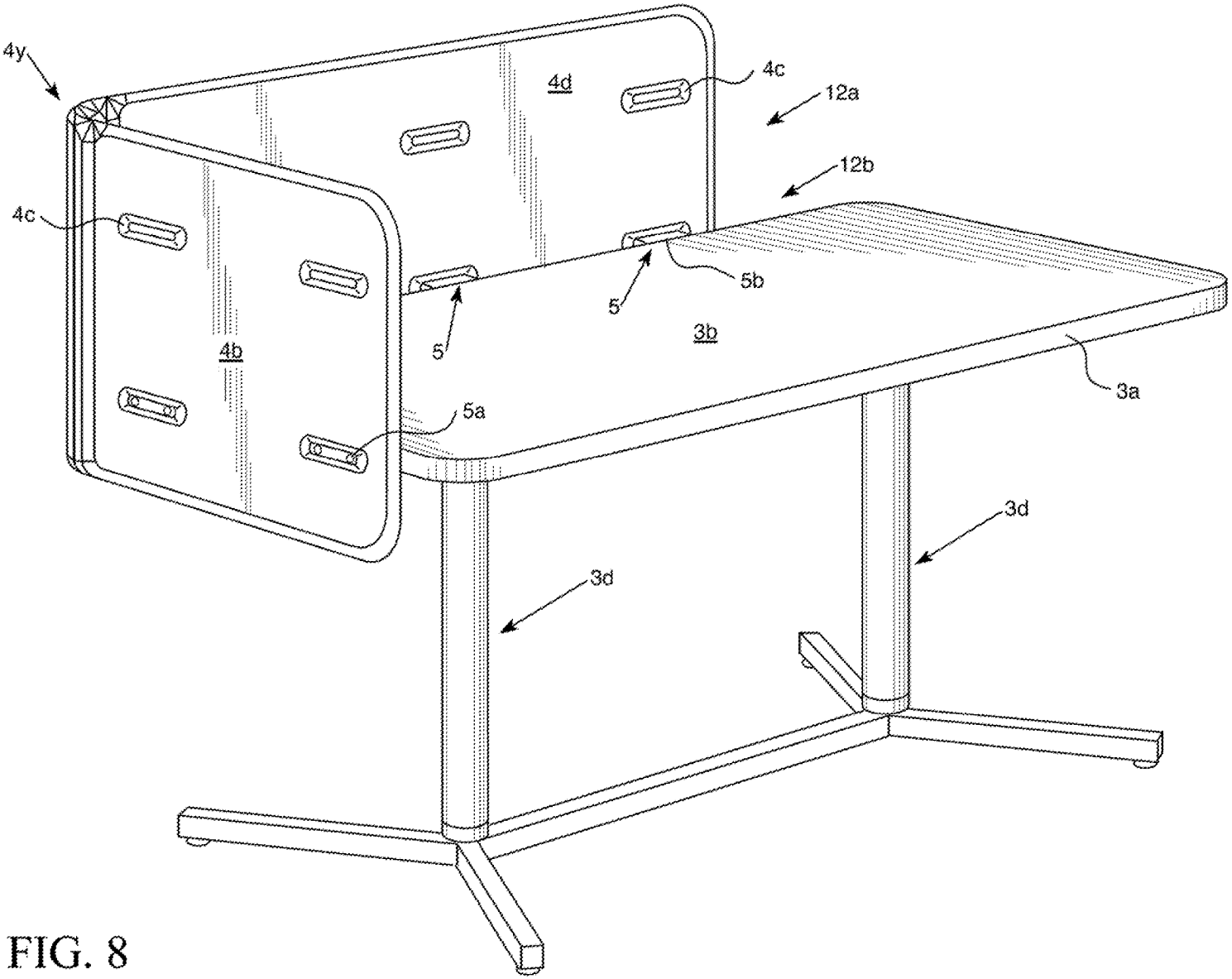
FIG. 8 is a perspective view of the second exemplary embodiment of the privacy apparatus having a screen attachment apparatus for attaching a screen body adjacent a work surface.
Figure 9:
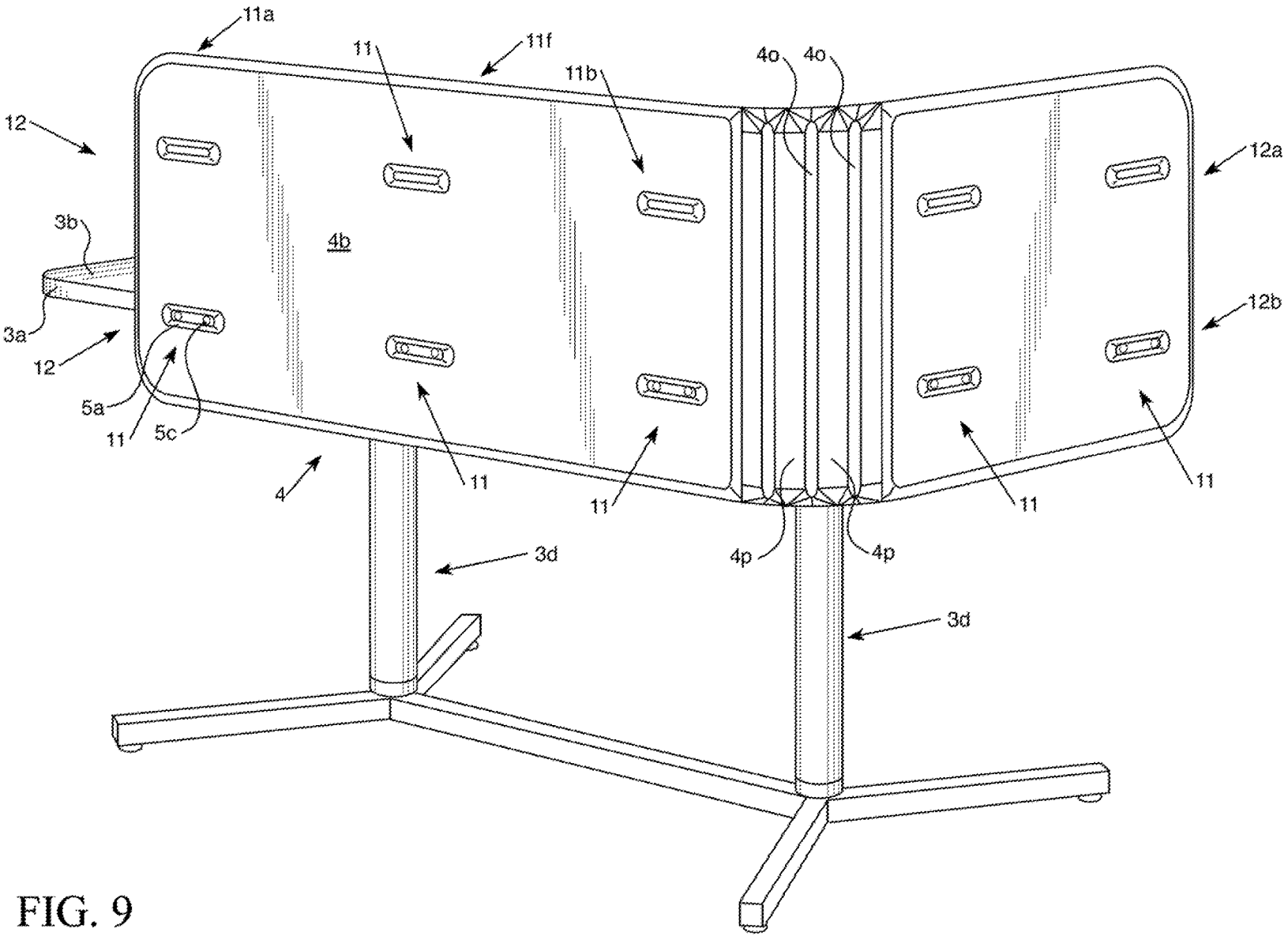
FIG. 9 is a perspective view of the second exemplary embodiment of the privacy apparatus having a screen attachment apparatus for attaching a screen body adjacent a work surface.
Figure 10:
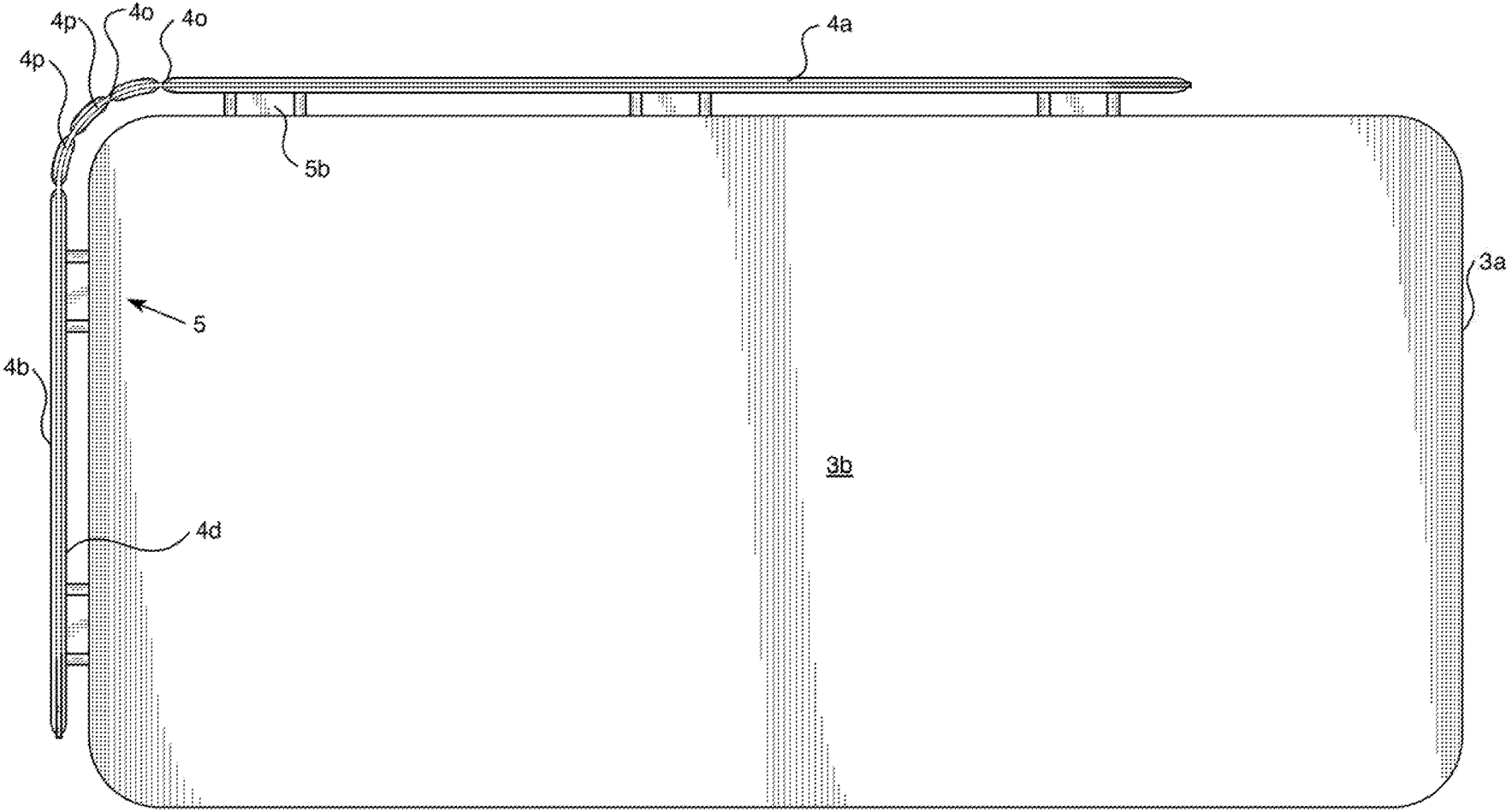
FIG. 10 is a top view of the second exemplary embodiment of the privacy apparatus having a screen attachment apparatus for attaching a screen body adjacent a work surface.
Figures 11, 12:
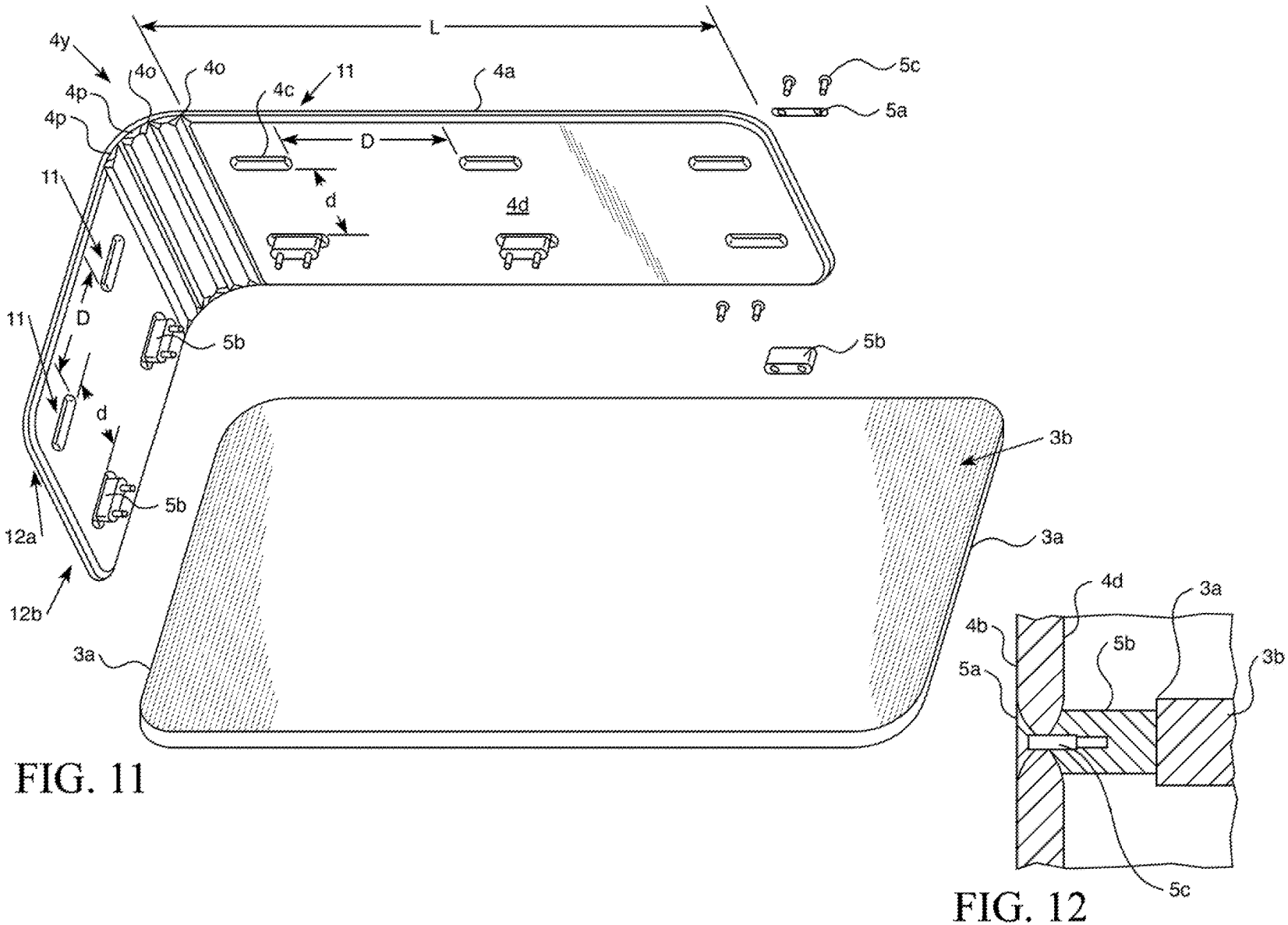
FIG. 11 is a fragmentary exploded via of the second exemplary embodiment of the privacy apparatus having a screen attachment apparatus for attaching a screen body adjacent a work surface.
FIG. 12 is a fragmentary cross sectional view of the second exemplary embodiment of the privacy apparatus having a screen attachment apparatus for attaching a screen body adjacent a work surface that illustrates an exemplary mounting connector 5 being positioned for attachment adjacent to a work surface 3*b*.
Figure 13:
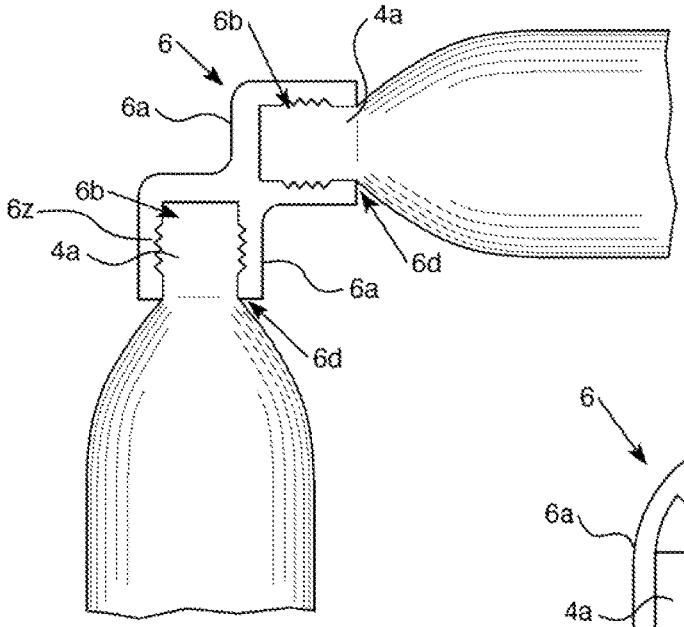
FIG. 13 is an enlarged fragmentary top view of the first exemplary embodiment of the privacy apparatus having a screen attachment apparatus for attaching a screen adjacent a work surface that illustrates a second exemplary screen body connector for connecting adjacent edges of screen bodies together.
Figure 14:
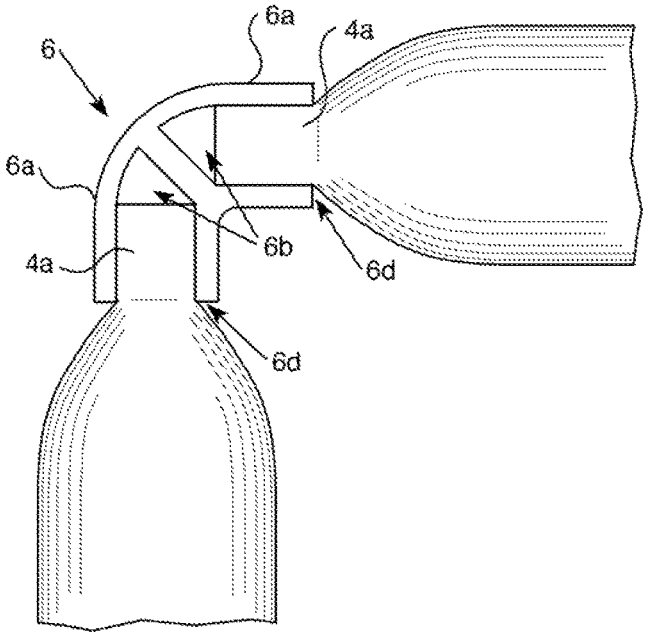
FIG. 14 is an enlarged fragmentary top view of the first exemplary embodiment of the privacy apparatus having a screen attachment apparatus for attaching a screen adjacent a work surface that illustrates a third exemplary screen body connector for connecting adjacent edges of screen bodies together.

Referring to FIGS. 1-20, a privacy screen apparatus 1 can include at least one screen body 4 that can be positioned adjacent to a work surface 3*b* of an article of furniture 3 (e.g. upper surface or a top surface). The article of furniture 3 can be, for example, a desk, a table, or a counter and the work surface 3*b* can be a tabletop, desktop or countertop. A plurality of mounting connectors 5 can be attached to the article of furniture via one or more fasteners 5*c* for attaching a screen body 4 adjacent to the work surface 3*b*.

The article of furniture 3 can include a base that includes a plurality of legs 3*d* that are configured to support the work surface 3*b* on a floor. The legs 3*d* can be attached to a lower surface 3*c* that is opposite the work surface 3*b* to support the work surface 3*b* and be configured to extend downwardly from adjacent the lower surface 3*c* to at least one foot (e.g. glides or castors). In some embodiments, each leg 3*d* can be connected to a floor contacting base element that has a plurality of glides or castors, such as the embodiment shown in FIGS. 7-10.

The work surface 3*b* can have one or more peripheral edges 3*a*. For circular or oval shaped work surfaces 3*b*, there may be a single continuous peripheral edge 3*a* defining the perimeter of the work surface. For rectangular or polygonal shaped work surfaces, there may be a plurality of peripheral edges 3*a* that each define a side or end of the work surface (e.g. front edge extending between right and left sides, a right side edge extending between front and rear sides, a left side edge extending between front and rear sides opposite the right side edge, a rear edge opposite the front edge extending between the left and right side edges, etc.).

There may be a screen body 4 positioned adjacent one or more of the peripheral edges 3*a* of the work surface 3*b*. Each screen body can have a height H, a length L, and a thickness T. The screen body can be comprised of foam, wood, or other material (e.g. polyethylene terephthalate (PET) substrate or other type of substrate composed of a polymeric or composite material with a fabric covering, felt covering, leather covering, another type of covering, or no covering, etc.). The screen body 4 can also have a covering that covers the entirety of the exterior surface of the body or at least a portion of the exterior surface of the body. The covering can be a polymeric film, a leather covering, or a fabric covering. In yet other embodiments, the covering could be composed of another type of material (e.g. tackable material, cork, mesh, etc.).

In some embodiments, a screen body 4 can be elongated and be configured to bend or flex for positioning around corners at the interface of different edges 3*a* or bends in an edge 3*a*. In other embodiments, there may be a screen body edge connector 6 for connecting a peripheral edge 4*a* of first screen body to an adjacent peripheral edge 4*a* of another screen body at a position that is adjacent to such an interface of work surface peripheral edges 3*a* or bend of a work surface peripheral edge 3*a*.

Each screen body 4 can have a first face 4*b* and a second face 4*d* opposite the first face 4*b*. The first face 4*b* can extend from a bottom peripheral edge 4*a* of the screen body to the top peripheral edge 4*a* of the body between the left peripheral edge 4*a* of the screen body and the right peripheral edge 4*a* of the screen body so that the first face 4*b* defines a surface of the screen body that faces toward a first direction. The second face 4*d* can extend from the bottom peripheral edge 4*a* of the screen body 4 to the top peripheral edge 4*a* of the screen body 4 between the left peripheral edge 4*a* of the screen body 4 and the right peripheral edge 4*a* of the screen body so that the second face 4*d* defines a surface of the screen body 4 that faces toward a second direction that is opposite the direction at which the first face 4*b* faces. For example, the first face 4*b* may be the front face and the second face may be the rear face (or vice versa). As another example, the second face 4*d* can directly face a peripheral edge 3*a* of a work surface 3*b* and the first face 4*b* may face toward a direction that is opposite the direction at which the second face 4*d* faces.

Each screen body 4 can define a plurality of recesses 4*c*. The recesses 4*c* can be aligned in columns 11 and rows 12 of recesses 4*c*. There may be a plurality of columns 11 of recesses 4*c* defined in the first face 4*b* of the screen body 4. There may also be a plurality of columns 11 of recesses 4*c* defines in the second face 4*d* of the screen body 4. Each column 11 of recesses 4*c* in the first face 4*b* can be aligned with and correspond with a column of recesses 4*c* in the second face 4*d*. For instance, a respective one of each of the spaced apart recesses 4*c* in a column 11 in the first face 4*b* can be positioned to correspond to a position of a spaced apart recess of a column 11 of recesses 4*c* defined in the second face 4*d* of the screen body 11. Such corresponding columns of recesses in the first and second faces 4*b* and 4*d* can be considered a pair of corresponding columns 11 of recesses or a set of columns 11 of recesses.

In some embodiments, each screen body can include a first column 11*a*, and a second column 11*b* of recesses 4*a*. Each recess within a column 11 can be spaced apart by a pre-selected vertical distance d from an immediately adjacent recess within that same column. The first column 11*a* can be adjacent a first edge of the screen body 4 and the second column 11*b* can be adjacent a second edge of the screen body 4. In some screen bodies, there may be at least one other column between the first and second columns 11*a* and 11*b*. For instance, there may be a third column 11*c* of recesses between the first and second columns 11*a* and 11*b*. The third column of recesses can be positioned along a central section or intermediate section of a face of the screen body, for example.

Each screen body 4 can also include rows 12 of spaced apart recesses, such as a first row 12*a*, a second row 12*b*, and a third row 12*c*. Each row of recesses can be aligned with each other horizontally and be configured to be parallel to recesses of other rows 12. Each recess within a row of recesses can be spaced apart from an immediately adjacent recess by a pre-selected horizontal distance D. The first row 12*a* can be an upper row, the second row 12*b* can be a row that is lower than the first row 12*a*. The third row 12*c* can be a row that is lower than the second row 12*b*. In some embodiments in which there are only three rows 12, the second row may be a central row or intermediate row. The recesses in a row 12 of spaced apart recesses 4*c* can be aligned with each other and be parallel with each other.

The first face 4*b* and the second face 4*d* of each screen body 4 can each include columns 11 of spaced apart recesses 4*c*. For example, there may be a first column 11*a* defined in the first face 4*b* and a first column 11*a* of recesses 4*c* defined in the second face 4*d*. Each recess of the first column 11*a* defined in the first face 4*b* can be positioned to correspond to a position of a respective one of the recesses of the first column 11*e* in the second face 4*d* such that this pair of first columns 11*a*, 11*e* defines a set of corresponding columns of recesses. As another example, there may be a second column 11*b* defined in the first face 4*b* and a second column 11*d* of recesses 4*c* defined in the second face 4*d*. Each recess of the second column 11*b* defined in the first face 4*b* can be positioned to correspond to a position of a respective one of the recesses of the second column 11*d* in the second face 4*d* such that this pair of second columns 11*b* and 11*d* defines a set of corresponding columns of recesses. As yet another example, there may be a third column 11*f* of recesses 4*c* defined in the first face 4*b* and a third column 11*g* of recesses 4*c* defined in the second face 4*d*. Each recess of the third column 11*f* defined in the first face 4*b* can be positioned to correspond to a position of a respective one of the recesses of the third column 11*g* in the second face 4*d* such that this pair of third columns 11*f* and 11*g* defines a set of corresponding columns of recesses.

Rows 12 of recesses 4*c* can be defined on opposite faces (e.g. the first face 4*b* and second face 4*d*) as well so that a row of recesses in the first face 4*b* correspond positionally to a respective row of recesses in the second face 4*d*. For instance, each recess in an upper row of recesses in the first face 4*b* can be positioned to correspond to a position of a respective recess in the upper row of recesses in the second face 4*d* such that this pair of upper rows defines a set of corresponding rows of recesses. Each recess in a lower row of recesses in the first face 4*b* can be positioned to correspond to a respective recess in the lower row of recesses in the second face 4*d* such that this pair of lower rows defines a set of corresponding rows of recesses. Each recess in an intermediate row that is between the upper and lower rows of recesses in the first face 4*b* can be positioned to correspond to a respective recess in a similar intermediate row of recesses in the second face 4*d* such that this pair of intermediate rows defines a set of corresponding rows of recesses.

There may be a mounting connector 5 for each column 11 of recesses for attachment of the screen body 4 to the article of furniture 3 to position the screen body 4 adjacent a peripheral edge 3*a* of a work surface to provide a visibility barrier to provide privacy and/or modesty. Each mounting connector 5 can include a first outer cap element 5*a* that is configured for positioning within a recess 4*c* of the first face 4*b* and a second inner element 5*b* that is configured for positioning within a recess of the second face 4*d* of the screen body 4. The second inner element 5*b* can be a body that is configured to facilitate attachment with the article of furniture (e.g. via direct attachment or via attachment to a third work surface attachment connector element 5*d*, etc.). The first outer cap element can be configured to facilitate attachment of the screen body to the second inner element 5*b*. The first outer cap element 5*a* and the second inner element 5*b* can each have at least one aperture defined therein to receive at least one fastener 5*c* (e.g. a bolt or screw, etc.). A respective aperture of the first outer cap element 5*a* can be alignable with a respective aperture of the second inner element 5*b* so that a fastener 5*c* is extendable from the second inner element, through the screen body 4 within recesses 4*c* in the first and second faces 4*b* and 4 that positionably correspond with each other into the first outer cap element 5*a*. The mounting connectors 5 can be configured so that a head of a fastener 5*c* (e.g. screw or bolt) can be accessed for driving the fastener through the first outer cap element 5*a*, screen body 4, and second inner element 5*b* via the first outer cap element 5*a* so that the head of the fastener is positioned in the first outer cap element 5*a*. The mounting connectors 5 can alternatively be configured so that a head of a fastener (e.g. screw or bolt) can be accessed for driving the fastener through the first outer cap element 5*a*, screen body 4, and second inner element 5*b* via the second inner element 5*b* so that the head of the fastener is positioned in the second inner element 5*b* when the screen body 4 is fastened to the mounting connector 5 via the at least one fastener 5*c* (e.g. a single fastener, two fasteners, more than two fasteners, etc.).

For mounting of a screen body 4, the fasteners 5*c* may be driven from the inner element 5*b* or cap element 5*a* through the screen body to the other of the cap element 5*a* or inner element 5*b* so that the fasteners define a hole in the screen body as they are driven through the screen body for attachment. The elements can have pre-drilled holes 5*y* to facilitate positioning of the fasteners 5*c* for positioning of the fasteners 5*c* and use of the fasteners to interconnect the screen body 4 to the elements of the mounting connector 5. The screen body can be composed of a resilient material that may be configured to expand to cover such a hole if or when the fastener is removed from the screen body 4. Holes in the screen body 4 can be formed via drilling (e.g. use of a drill to form the holes) that occurs prior to passing fasteners 5*c* through the screen body. The drilled holes can be drilled so they align with holes in the first outer cap elements 5*a* and second inner elements 5*b* of the mounting connectors 5. The fasteners 5*c* can be configured to extend to a work surface 3*b* for engaging the work surface and fastening the mounting connector 5 to the work surface 3*b* (e.g. as indicated in broken line in FIG. 12). In other embodiments, the fasteners may only be positioned for connecting the first outer cap element 5*a* to the second inner element 5*b*. A separate fastening mechanism may be used to attach the mounting connector 5 adjacent a work surface 3*b* (e.g. an adhesive, a bracket with one or more other fasteners for attaching the second inner element 5*b* to the lower surface 3*c*, etc.).

There may be a single mounting connector 5 for each corresponding pair of columns 11 of recesses that correspond to each other on opposite faces of the screen body. The first outer cap element 5*a* can be positioned in a recess of a first column of a pair of columns of recesses and the second inner element 5*b* can be positioned in the recess 4*c* in the other column of the pair of columns of recesses located on the opposite face of the screen body and in the recess 4*c* that corresponds to the recess in which the outer cap element 5*a* is positioned. The alignment of these portions of the mounting connector can facilitate the extending of at least one fastener through those elements and the screen body for mounting of the screen body to the article of furniture adjacent a peripheral edge 3*a* of the work surface 3*b*. The inner element 5*b* can be configured to matingly interlock with a portion of the article of furniture and/or be configured for being fastened or otherwise attached to the article of furniture (e.g. fastened or adhered to the lower surface 3*c* or a leg 3*d*, attached via a third work surface attachment connector element 5*d*, etc.).

There may be multiple mounting connectors 5 for a corresponding pair of rows 12 of recesses 4*c* on opposite faces of the screen body 4. In some embodiments, for mounting of the screen body 4, only a single pair of corresponding rows may be utilized. In other embodiments more than one corresponding pair of rows of recesses may be utilized for positioning of mounting connectors 5 (e.g. connectors for each of three pairs of corresponding rows or more than three pairs of corresponding rows, etc.).

The positional selection of each screen body 4 adjacent a peripheral edge 3*a* of a work surface 3*b* can be provided by the mounting connectors 5 and recesses 4*c*. For instance, the mounting connectors 5 can be positioned in the upper recesses of the first rows of recesses 12*a* defined in the opposite first and second faces 4*b* and 4*d* so that a majority of the height H of the screen body extends below the work surface 3*b* for providing a visibility barrier. A minor portion of the height H of the screen body 4 can extend above the work surface from such a positioning. Thereafter, the position of the screen body 4 can be changed to adjust the visibility barrier provided by the screen body. Fasteners 5*c* can be removed from the mounting connectors (or at least one of the first outer cap and the second inner element) as well as the screen body 4 so that the screen body can be positionally adjusted. The mounting connectors 5 can then be positioned in the second row 12*b* or third row 12*c* of recesses on opposite faces of the screen body 4 (e.g. first outer cap element 5*a* of a mounting connector in a recess of the second row or third row in the first face 4*b* and a second inner element 5*b* of the mounting connector in the recess of the second row or third row in the second face 4*d*). Fasteners 5*c* can then be passed through the first outer cap element 5*a* positioned in the recess 4*c* of the first face 4*b*, screen body 4 and second inner element 5*b* positioned in a corresponding recess 4*c* of the second face 4*d* for fastening of the screen body 4 to the article of furniture. If the second row of recesses are used for the positioning of the mounting connectors 5, the screen body's mounted position can change the positioning so that about half of the height H of the screen body extends above the work surface and about half of the height H of the screen body 4 extends below the work surface. If the third rows of recesses 4*c* are used, the screen body's mounted position can change the positioning so that most of the height H of the screen body extends above the work surface a minor portion of the height H of the screen body extends below the work surface.

Such adjustment of the position of the screen body between these different vertical orientations can be made multiple times as desired to adjust the privacy barrier provided by the screen body between providing mostly, or totally privacy screen protection (e.g. a visible barrier above the work surface), mostly (or totally) modesty screen protection (e.g. a visible barrier below the work surface), and a combination of significant privacy screen protection and significant modesty screen protection (e.g. a visible barrier significantly below and above the work surface). It should be appreciated that such repositioning can occur by the removal of the first outer cap elements 5*a* and subsequent repositioning of the first outer cap elements 5*a* and second inner elements 5*b* in respective recesses of a different pair of rows of recesses. The second inner elements 5*b* may be kept attached to the work surface during such repositioning or may also be removed for such repositioning.

In some embodiments, fasteners 5*c* that are passed through the mounting connectors 5 and screen body 4 can be aligned so that they each extend horizontally through the first outer cap element 4*a*, screen body 4, and second inner element 5*b*. The fasteners 5*c* can also all be positioned in horizontal alignment with each other.

The first outer cap element 5*a* can be sized and configured to fit within a recess 4*c* so that the cap element does not substantially jut out of the recess to provide a low profile attachment feature. Such positioning of the first outer cap element 5*a* can help ensure a low profile so that the outer cap element does not extend significantly away from the first face (e.g. is fully within the recess 4*c* so that the cap element does not extend past the outermost portion of the surface of the first face via its position in the recess 4*c*). The cap element coloring can also be configured to try and minimize the appearance of the cap element to try and avoid impacting the aesthetic effect of the first face (e.g. by being a color that is the same as the color of the first face, etc.) or to add color to the screen body to affect the aesthetic effect of the first face 4*b* (e.g. by being a contrasting color that differs from the color of the first face, etc.).

Adjacent screen bodies 4 can be mounted adjacent different peripheral edges 3*a* of a work surface 3*b*. For instance, a first screen body 4 can be positioned adjacent a left side peripheral edge and a second screen body 4 can be positioned adjacent a front side peripheral edge 3*a*. In some embodiments, the first screen body can be positioned so one of its peripheral edges 4*a* contacts another screen body's peripheral edge 4*a*. Such peripheral edges 4*a* of the screen bodies can be formed via cutting of the screen bodies to provide perforated edges that can facilitate a tight contact for such positioning to avoid any type of crack or space between the adjacent screen bodies (or to minimize any type of space to a minimal space) to help provide a full visible barrier. In some embodiments, the edges of the screen bodies to be closely positioned next to each other for being in contact with each other can be formed via laser cut or otherwise cut to provide a laser perforated edge to facilitate such positioning.

In other embodiments, the peripheral edges 4*a* of the screen bodies that are immediately adjacent to each other can be connected together. For instance, immediately adjacent peripheral edges 4*a* of different screen bodies 4 can be connected to each other via a screen body edge connector 6 to block any gap or space that may be present between these screen bodies. The screen body edge connector 6 can include a body 6*a* that defines apertures 6*b*. Each aperture 6*b* can have a mouth 6*d* for receiving a peripheral portion of the peripheral edge of a screen body 4. As can be appreciated from FIGS. 13, 14 and 15, the mouth 6*d* and aperture 6*b* can be sized and configured to receive and retain a peripheral edge 4*a* of the screen body 4. A glue or other type of adhesive can be positioned in the aperture 6*b* to help facilitate the connection or retention of the peripheral edge in the aperture 6*b*. The shape of the aperture 6*b* and mouth can be any of a number of different shapes or configurations to help facilitate a connection with the peripheral edges 4*a* of a screen body. In some embodiments teeth 6*z* can be defined in the body of the connector to facilitate an interference connection and/or attachment between the peripheral edge 4*a* and the connector 6.

Figure 15:
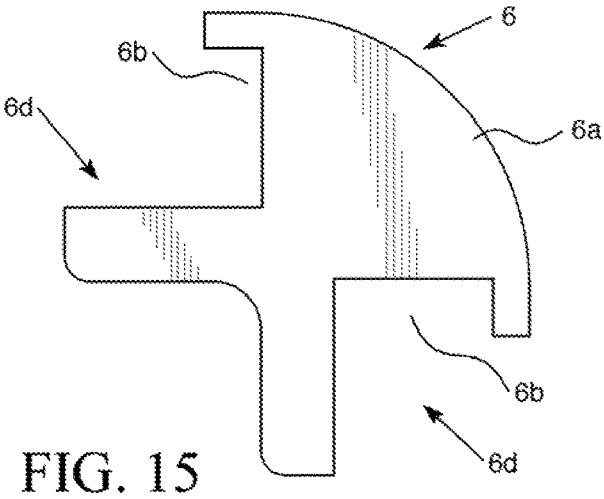
FIG. 15 is an enlarged fragmentary top view of the first exemplary embodiment of the privacy apparatus having a screen attachment apparatus for attaching a screen adjacent a work surface that illustrates a fourth exemplary screen body connector for connecting adjacent edges of screen bodies together.
Figure 16:
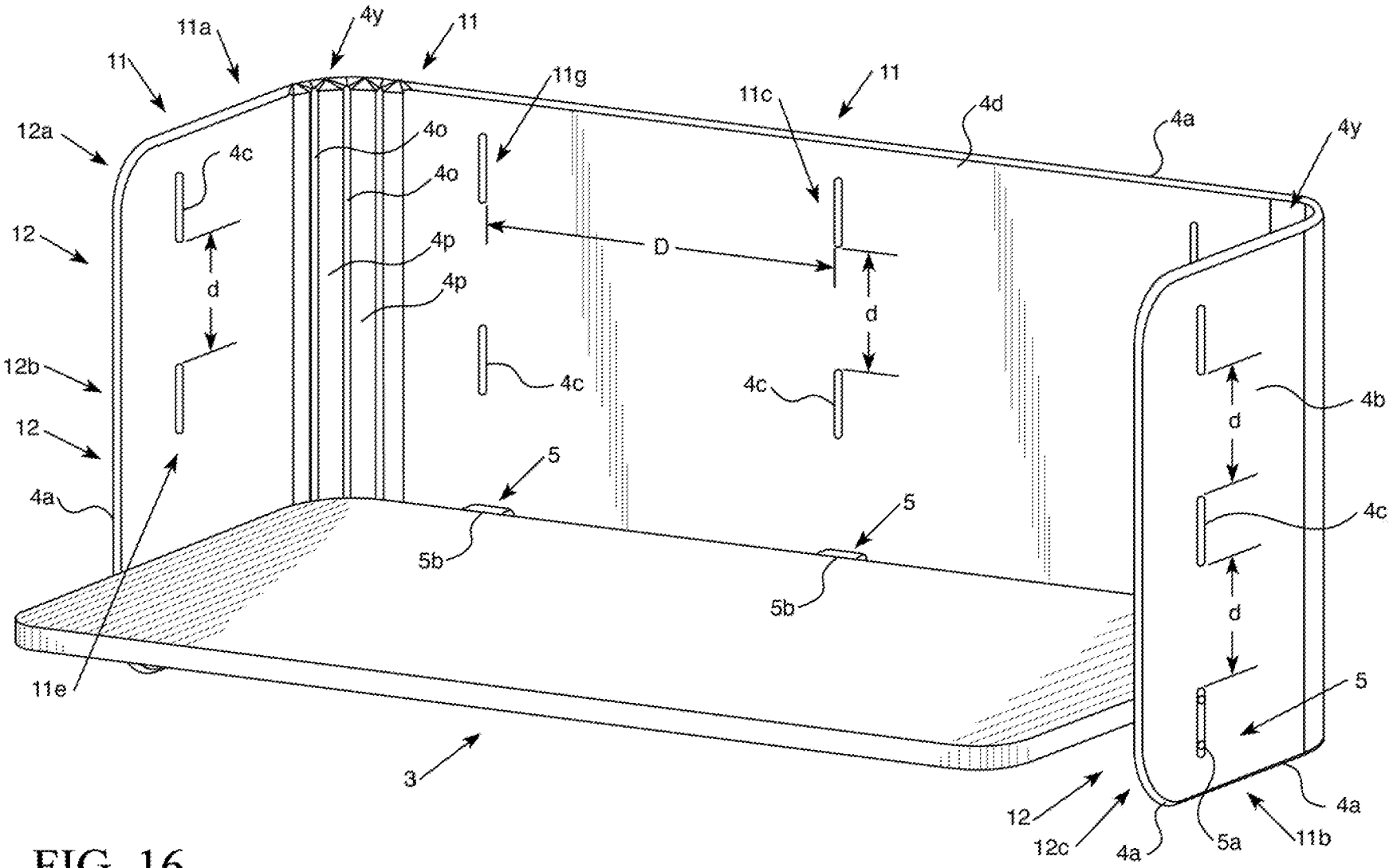
FIG. 16 is a perspective view of a third exemplary embodiment of the privacy apparatus having a screen attachment apparatus for attaching a screen body adjacent a work surface.
Figure 17:
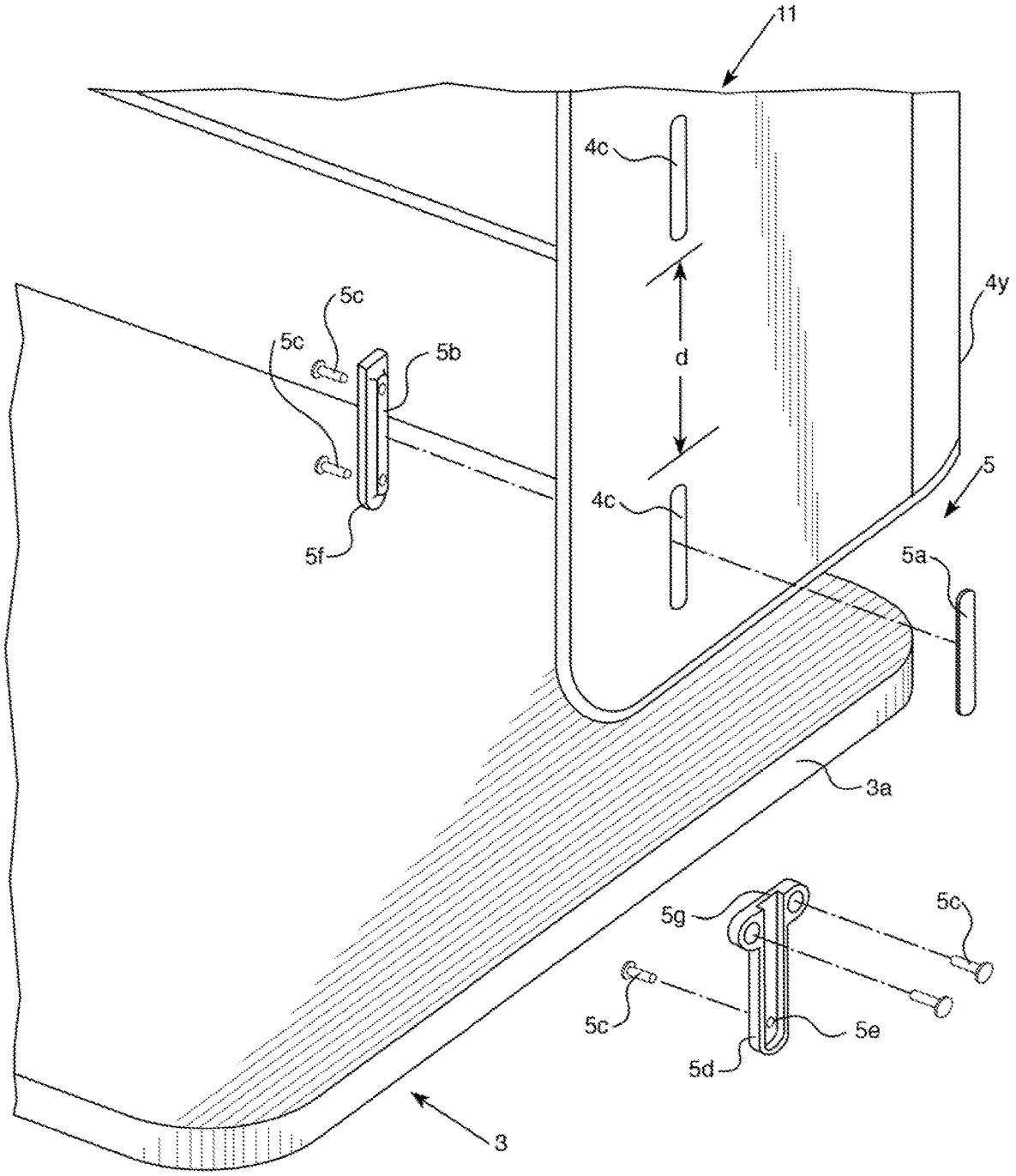
FIG. 17 is a fragmentary exploded view of the third exemplary embodiment of the privacy apparatus having a screen attachment apparatus for attaching a screen body adjacent a work surface. It should be appreciated that the exemplary screen body of this embodiment is illustrated in phantom view in FIG. 17.
Figure 18:
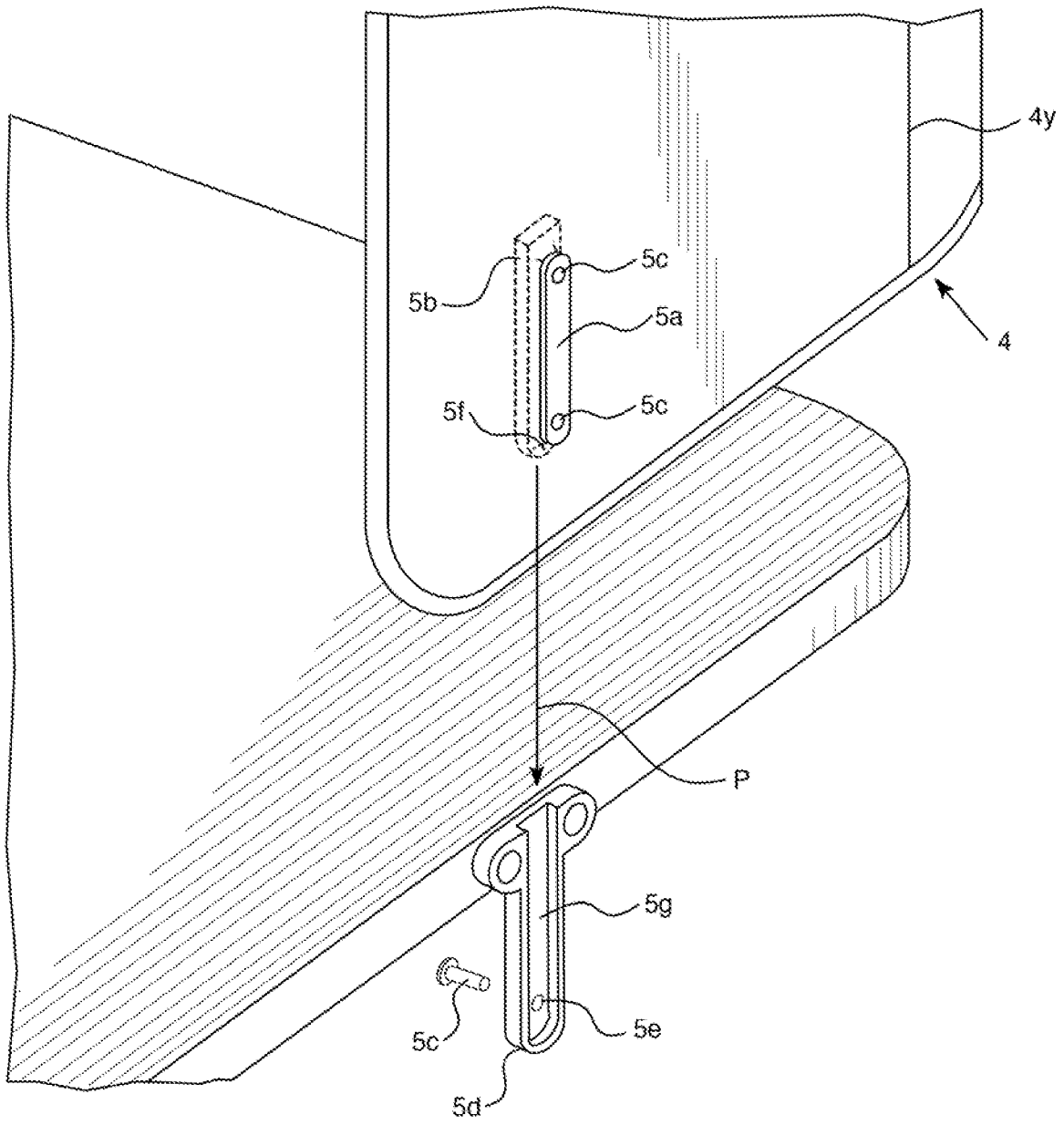
FIG. 18 is a fragmentary exploded view of the third exemplary embodiment of the privacy apparatus similar to FIG. 17 illustrating an exemplary privacy screen attachment connector for positioning within an exemplary work surface bracket. It should be appreciated that the exemplary screen body of this embodiment is illustrated in phantom view in FIG. 18.
Figure 19:
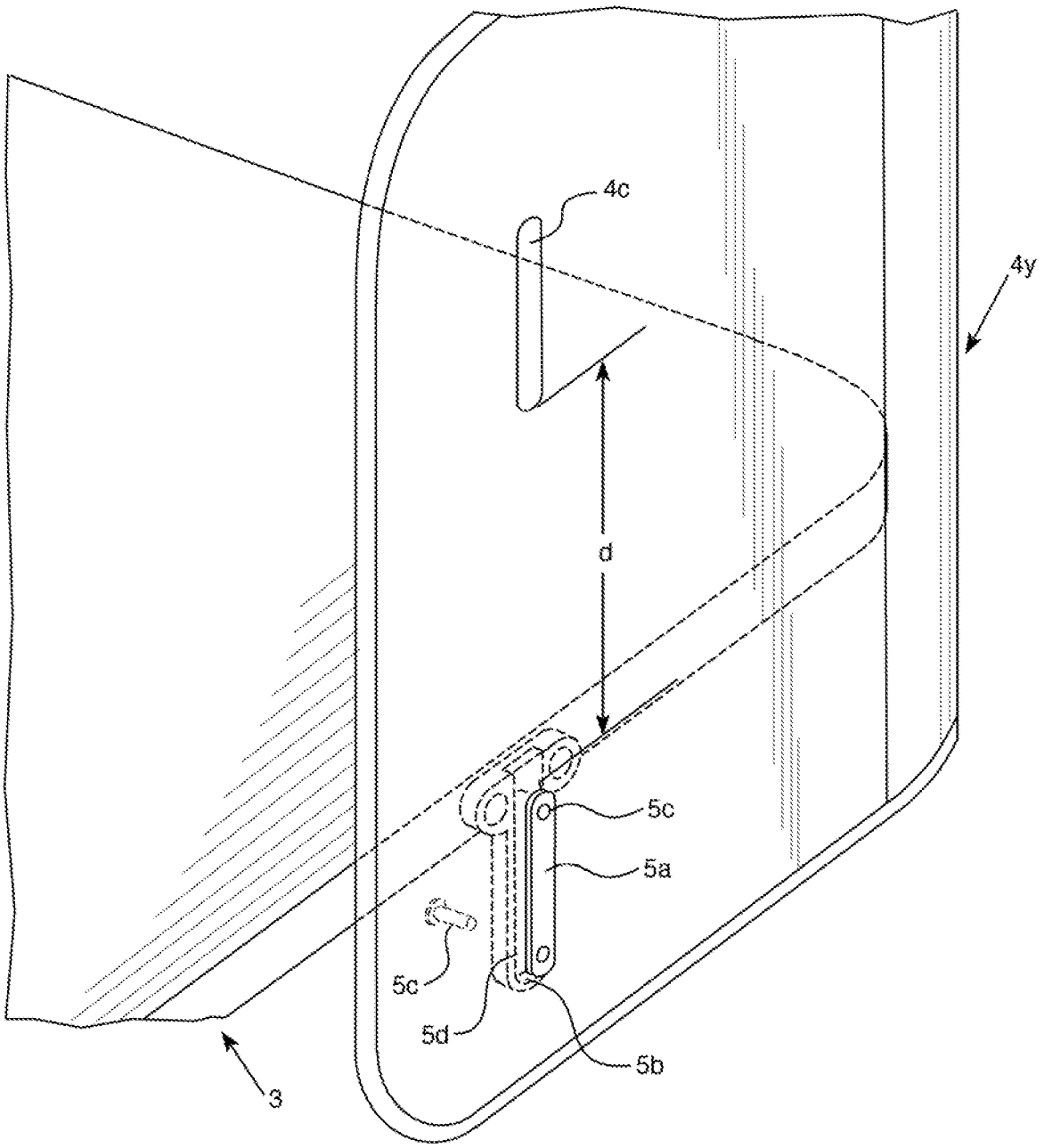
FIG. 19 is a fragmentary perspective view of the third exemplary embodiment of the privacy apparatus illustrating the screen body in phantom view to better illustrate the privacy screen attachment connector positioned within the work surface bracket.
Figure 20:
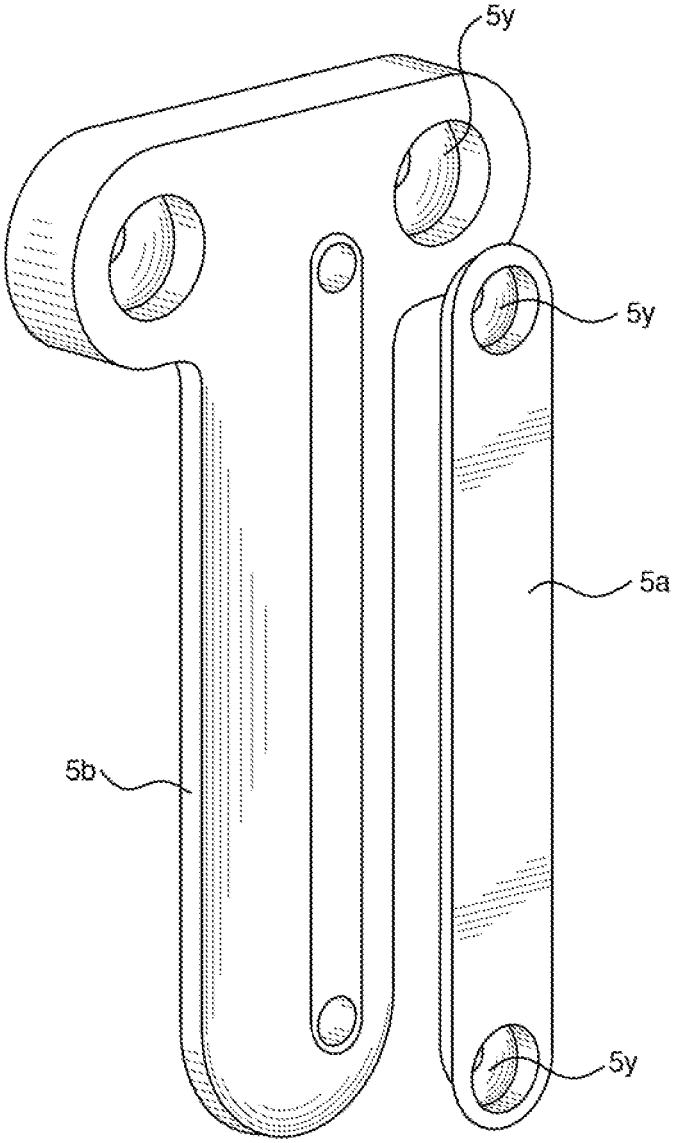
FIG. 20 is an exploded view of an alternative screen body attachment mechanism that may utilize a different type of screen attachment mechanism as compared to the third exemplary embodiment of the privacy apparatus shown in FIGS. 17-19.

In some embodiments, an outer edge of the body 6*a* that defines the aperture 6*b* and mouth 6*d* can be structured so that the outer edge of each mouth 6*d* proj ects outwardly less than the inner edge of the body defining the inner edge of the mouth 6*d*. Such an embodiment is shown in FIG. 15. In yet other embodiments, the inner edge of the body can project outwardly farther than the outer edge. In yet other embodiments, such as the embodiments shown in FIGS. 13 and 14, the inner and outer edges on the inner and outer sides of the body 6*a* can extend the same distance or about the same distance to define the aperture 6*b* and mouth 6*d*. In some embodiments, the screen body edge connector 6 can include a covering the covers at least the the side of the body facing the outwardly away from a work surface to which the screen bodies 4 are attached so that at least the outer surface of the connector provides a desired aesthetic effect. In other embodiments, the body of the screen body edge connector 6 may not have such a covering or can include a covering that covers both the outer facing side and the inner facing side of the body of the connector.

In some embodiments, an interference fit connector 6*c* can be positioned in the aperture 6*b* adjacent the mouth 6*d* of the aperture. The interference fit connector 6*c* can be structured to define an inner opening 6*i* that is in communication with the mouth 6*d* of the aperture 6*b* of the body 6*a*. Each interference fit connector 6*c* an include prongs 6*e* that are configured to interlock with projections 6*f* that define mouth 6*d* for retaining the interference fit connector 6*c* in the aperture 6*b*. The prongs 6*e* can be configured to contact opposite sides of the peripheral edge to provide an interference attachment of the peripheral edge of a screen body 4 within the aperture 6*b* of the body 6*a*. An outermost portion of the peripheral edge 4*a* of the screen body 4 can be received within the aperture 6*b* and also within the opening 6*i* of the interference fit connector 6*c* such that the peripheral edge 4*a* is held within the opening 6*i* of the interference fit connector 6*c* positioned in the aperture 6*b*.

Each body 6*a* can include at least a pair of apertures 6*b*. One such aperture's mouth 6*d* can face a first direction and the other aperture's mouth 6*d* can face a direction that is about 90° relative to that first direction to receive a peripheral edge of a screen body that extends along its length in a direction that is about perpendicular (e.g. being perpendicular or within 5° of being perpendicular) to the direction at which the length of the other screen body extends. Other embodiments of the screen body edge connector 6 can be structured so that these apertures are oriented relative to each other differently (e.g. the mouths 6*d* of the apertures 6*b* face in opposite direction or directions that are oriented so that the mouth of one angle faces a direction that is at a different angle (e.g. a 45° or 60° etc.) relative to the direction the mouth 6*d* of the other aperture 6*b* faces. Such other screen body edge connector 6 configurations can permit coupling of different screen bodies 4 adjacent the work surface 3*b* to accommodate different shapes of a work surface 3*b*.

The body 6*a* of the screen body edge connector 6 can be composed of metal, a polymeric material, or an elastomeric material. The body 6*a* of the interference fit connectors 6*c* can be composed of metal or other suitable material. There may be multiple interference fit connectors 6*c* within each aperture 6*b* defined in the body 6*a*. In some embodiments, each aperture 6*b* that is in communication with mouth 6*d* can be defined as a groove, a channel, a slit or a slot within the body 6*a* that extends along the length or height of the body 6*a*. Multiple interference fit connectors 6*c* can be positioned in such a groove, channel, slit or slot so that they are each entirely within the groove, channel, slit or slot and are also spaced apart from the other interference fit connectors 6*c* positioned in that groove, channel, slit or slot.

In other embodiments, the screen body 4 can be configured to flex or bend by having at least one intermediate flexing section 4*y*. Such a body configuration can permit screen bodies 4 to be mounted without having to utilize a screen body edge connector 6. Of course, it is also contemplated that each intermediate flexing section can include corrugated portions at which a portion of a screen body is moveable relative to another portion of the screen body. Each such intermediate flexing section 4*y* that may be configured as a corrugated portion of the screen body 4 can include narrow grooves 4*o* defined between wider, thicker segments 4*p*. The narrow grooves 4*o* can each be positioned so that there is a groove that extends vertically along the height H of the screen body and each groove can be separated from an immediately adjacent other groove by a wider segment 4*p* that extends vertically along the height H of the screen body 4. The wider segment 4*p* is wider than the narrow groove 4*o*. The screen body can bend via the narrow grooves 4*o* so that a distal portion of a screen body can be adjacent multiple peripheral edges 3*a* or a curved peripheral edge 3*a* of a work surface 3*b* and be curved or rounded at an interface between adjacent peripheral edges 3*a* or a bend of a continuous peripheral edge.

Embodiments of the privacy screen apparatus 1 and screen attachment apparatus can utilize recesses 4*c* that are in communication with each other to define a shaped hole or just define spaced apart recesses that may be aligned with each other where a thickness of the screen body is present between matching recesses on opposite faces of the screen body. The shape and size of the defined recesses can differ to meet a particular desired aesthetic effect or other design criteria and the screen attachment mechanism used in such embodiments can also utilize different connector components or connector arrangements. For instance connectors 5 can be configured as utilizing three connector parts that are to work in conjunction with fasteners 5*c*. Of course, a two part connector or another type of multiple part connector (e.g. four part, five part, etc.) can be utilized as well.

Examples of privacy screen attachment apparatus utilizing a multiple part connector can be appreciated from FIGS. 1-20. For example, an exemplary mounting connector 5 can utilize a first outer cap element 5*a*, a second inner element 5*b*, and a third work surface attachment connector element 5*d*. The third work surface attachment connector element 5*d* can be structured and shaped for attachment to a work surface to be positioned adjacent a peripheral edge 3*a* of the work surface and have a receptacle 5*g* defined therein (e.g. as an aperture, groove, or other type of opening) that is shaped to receive and retain the second inner element 5*b*. The second inner element 5*b* can be shaped and configured to have a mating profile 5*f* that corresponds to the shape of the receptacle 5*g* for being slid into the receptacle 5*g* of the third work surface attachment connector element 5*d* for being retained therein by a downward motion P of the second inner element 5*b* within the receptacle 5*g*. The positioning of the screen body 4 can occur so that the second inner elements 5*b* of multiple mounting connectors are slid into their respective receptacles 5*g* at a same time to facilitate attachment of the screen body to a work surface 3. But, such attachment need not occur simultaneously. In some embodiments, different third work surface attachment connector elements 5*d* can be attached to the screen body at different times via their respective second inner elements 5*b*.

The third work surface attachment connector element 5*d* can have a hole 5*e* that is defined to receive a screw or other type of fastener 5*c* that can be passed into the receptacle 5*g* for contacting the second inner element 5*b* to help retain and hold the second inner element 5*b* within the receptacle. In other embodiments, such a hole and fastener may not be required due to the interference fit and/or mating profiles of the receptacle 5*g* of the third work surface attachment connector element 5*d* and the mating profile 5*f* of the second inner element 5*b*.

For installation, attachment and positioning adjustment, the privacy screen attachment mechanism can be configured so that the third work surface attachment connector elements 5*d* are maintained in their position and attachment to a work surface 3 while the first outer cap element 5*a* is separated from the second inner element 5*b* for each mounting connector 5 for adjusting which row of recesses 4*c* the connectors 5 will be positioned in. After the first outer cap element 5*a* is separated from the second inner element 5*b* (e.g. removal of fasteners 5*c* from between these two elements, etc.), the screen body can be moved to adjust which row of recesses the first outer cap elements 5*a* and second inner elements 5*b* should be positioned in (e.g. movement form lowest row to highest row, movement from lowest row to an intermediate row, etc.). The first outer cap elements 5*a* can be re-attached to their respective second inner elements 5*b* in the new row of recesses 4*c* for repositioning of the screen body 4. For such adjustment, the second inner elements 5*b* may be kept in the receptacles 5*g* during the repositioning. Alternatively, the second inner elements 5*b* may be removed from the receptacles 5*g* for attachment with the first outer cap elements 5*a* in their respective recesses 4*c* of the desired pair of rows of recesses and, after such repositioning and reattachment occurs, the second inner elements 5*b* can be returned to the receptacles 5*g* of the third work surface attachment connector elements 5*d*. Such repositioning can allow the screen body to be repositioned without having to reposition the work surface attachment connector elements 5*d*. This can permit an easier readjustment by only requiring the manipulation of a limited number of fasteners and repositioning of the first and second elements of the mounting connector 5 within desired recesses 4*c* while also permitting the first outer cap element 5*a* and second inner cap element 5*b* for each mounting connector 5 to be more easily aligned for passing the fasteners 5*c* through the screen body for attachment and repositioning.

The recesses 4*c* and connector elements can be shaped to be elongated and positioned to extend vertically along their length as shown in FIGS. 16-19 or horizontally along their length as shown in FIGS. 1-4 and 7-11. In yet other embodiments, inner and outer connector elements and recesses can be circular in shape or be square in shape or have yet another type of shape. The vertical and horizontal spacing between immediately adjacent recesses 4*c* in the rows and columns of recesses 4*c* can also be adjusted to meet a particular set of design criteria (e.g. size and weight of the screen body, size and shape of article of furniture having the work surface 3, shape and size of connectors 5, extent of adjustable positioning that is desired, etc.).

It should be understood that other modifications to the privacy screen apparatuses and screen attachment apparatuses can be made to meet a particular set of design criteria. For example, it is contemplated that a particular feature described, either individually or as part of an embodiment, can be combined with other individually described features, or parts of other embodiments. The elements and acts of the various embodiments described herein can therefore be combined to provide further embodiments. As another example, the size, shape and weight of a screen body 4 can be any size or shape to meet a particular set of design criteria. As yet another example, use of a covering and/or the extent to which a covering may cover an exterior surface of a screen body 4 can be adjusted as needed to meet particular design criteria and/or to provide a desired aesthetic effect (e.g. colored film to cover a foam body, no use of a covering, use of a leather covering, etc.). As yet another example, the type of mounting connector 5 that is utilized in an embodiment of the privacy screen apparatus or privacy screen attachment apparatus may be any type of connector structure geometry that may facilitate use of a pre-selected fastening mechanism (e.g. bolts, screws, etc.) to meet a particular set of design criteria.

Therefore, while certain exemplary embodiments of privacy screen apparatuses, connection mechanisms for privacy screen apparatuses (e.g. screen attachment apparatuses), and methods of making and using the same have been discussed and illustrated herein, it is to be distinctly understood that the invention is not limited thereto but may be otherwise variously embodied and practiced within the scope of the following claims.

What is claimed is:

1. A privacy screen apparatus comprising:

a screen body, the screen body have a first face and a second face opposite the first face, the first face having a first column of spaced apart recesses and a second column of spaced apart recesses, the second face having a first column of spaced apart recesses and a second column of spaced apart recesses, each recess of the first column of spaced apart recesses of the first face being positioned to correspond to a position of a respective recess of the first column of spaced apart recesses of the second face; each recess of the second column of spaced apart recesses of the first face being positioned to correspond to a position of a respective recess of the second column of spaced apart recesses of the second face;

a plurality of mounting connectors comprising a first mounting connector and a second mounting connector, each of the mounting connectors comprising a first outer cap element and a second inner element configured for attachment to an article of furniture adjacent a work surface of the article of furniture, the first outer cap element of the first mounting connector sized and configured for positioning in any of the recesses of the first column of spaced apart recesses of the first face; the first outer cap element of the second mounting connector sized and configured for positioning in any of the recesses of the second column of spaced apart recesses of the first face; the second inner element of the first mounting connector sized and configured for positioning in any of the recesses of the first column of spaced apart recesses of the second face; the second inner element of the second mounting connector sized and configured for positioning in any of the recesses of the second column of spaced apart recesses of the second face.

2. The privacy screen apparatus of claim 1, wherein:

the first face has a first row of spaced apart recesses that include an upper recess of the first column of recesses in the first face and an upper recess of the second column of recesses in the first face that are aligned with each other;

the first face has a second row of spaced apart recesses that include a lower recess of the first column of recesses in the first face and a lower recess of the second column of recesses in the first face that are aligned with each other;

the second face has a first row of spaced apart recesses that include an upper recess of the first column of recesses in the second face and an upper recess of the second column of recesses in the second face that are aligned with each other; and the second face has a second row of spaced apart recesses that include a lower recess of the first column of recesses in the second face and a lower recess of the second column of recesses in the second face that are aligned with each other.

3. The privacy screen attachment apparatus of claim 2, wherein:

each of the mounting connectors comprises at least one fastener that is extendable from the first outer cap element to the second inner element while also passing through the screen body.

4. The privacy screen apparatus of claim 3, wherein each fastener is a bolt or a screw.

5. The privacy screen apparatus of claim 1, wherein each of the mounting connectors comprises a third work surface attachment connector element for attachment to a work surface, the third work surface attachment connector element having a receptacle for receiving the second inner element.

6. The privacy screen apparatus of claim 5, wherein the third work surface attachment connector element has a hole in communication with the receptacle for positioning of a fastener to help retain the second inner element within the receptacle.

7. The privacy screen apparatus of claim 5, wherein the second inner element has a profile sized and shaped to mate with a size and shape of the receptacle.

8. The privacy screen apparatus of claim 7, wherein the profile of the second inner element is configured to facilitate downward motion of the second inner element into the receptacle for positioning the second inner element in the receptacle.

9. The privacy screen apparatus of claim 1, wherein the screen body is a first screen body, the privacy screen apparatus also comprising:

a screen body edge connector configured to connect a peripheral edge of the first screen body to a peripheral edge of a second screen body.

10. The privacy screen apparatus of claim 9, wherein the screen body edge connector comprises a body defining a first aperture having a first mouth to receive a peripheral portion of the peripheral edge of the first screen body, the body of the screen body edge connector also defining a second aperture having a second mouth to receive a peripheral portion of the peripheral edge of the second screen body so that the body of the screen body edge connector is positionable between the first screen body and the second screen body to block any gap or space between the peripheral edge of the first screen body and the peripheral edge of the second screen body.

11. A privacy screen attachment apparatus comprising:

a plurality of mounting connectors comprising a first mounting connector and a second mounting connector, each of the mounting connectors comprising a first outer cap element and a second inner element configured for attachment to an article of furniture adjacent a work surface of the article of furniture, the first outer cap element of the first mounting connector sized and configured for positioning in any recess of a first column of spaced apart recesses of a first face of a privacy screen body; the first outer cap element of the second mounting connector sized and configured for positioning in recess of a second column of spaced apart recesses of the first face;

the second inner element of the first mounting connector sized and configured for positioning in any recesses of a first column of spaced apart recesses of a second face of the privacy screen body; the second inner element of the second mounting connector sized and configured for positioning in any recess of a second column of spaced apart recesses of the second face.

12. The privacy screen attachment apparatus of claim 11, wherein each of the mounting connectors comprises a third work surface attachment connector element for attachment to a work surface, the third work surface attachment connector element having a receptacle for receiving the second inner element.

13. The privacy screen attachment apparatus of claim 12, wherein the third work surface attachment connector element of each of the mounting connectors has a hole in communication with the receptacle for positioning of a fastener to help retain the second inner element within the receptacle.

14. The privacy screen attachment apparatus of claim 12, wherein the second inner element has a profile sized and shaped to mate with a size and shape of the receptacle to facilitate downward motion of the second inner element into the receptacle for positioning the second inner element in the receptacle.

15. The privacy screen attachment apparatus of claim 11, comprising:

a plurality of fasteners comprising a first fastener and a second fastener, the first fastener being extendable from the first outer cap element of the first mounting connector to the second inner element of the first mounting connector, the second fastener being extendable from the first outer cap element of the second mounting connector to the second inner element of the second mounting connector.

16. The privacy screen attachment apparatus of claim 15, wherein each of the fasteners is a bolt or a screw.

17. The privacy screen attachment apparatus of claim 15, comprising:

a privacy screen body having the first face and the second face opposite the first face.

18. The privacy screen attachment apparatus of claim 15, wherein the privacy screen body is comprised of foam, wood, or polymeric material.

* * * * *